US005123125A

United States Patent [19]

Menge

[11] Patent Number: 5,123,125

[45] Date of Patent: Jun. 23, 1992

[54] FLUSHING TANK FOR USE WITH TOILET BOWLS

[76] Inventor: Heinrich Menge, Eissendorfer Pferdeweg 45, D-2100 Hamburg 90, Fed. Rep. of Germany

[21] Appl. No.: 569,985

[22] Filed: Aug. 17, 1990

[30] Foreign Application Priority Data

Aug. 17, 1989 [DE] Fed. Rep. of Germany ..... 3927200

[51] Int. Cl.[5] ..... E03D 9/52

[52] U.S. Cl. ..... 4/349; 4/213

[58] Field of Search ..... 4/213, 214, 215, 216, 4/349

[56] References Cited

U.S. PATENT DOCUMENTS

| | | | |
|---|---|---|---|
| 288,573 | 11/1883 | Hyde | 137/247.25 X |
| 516,011 | 3/1894 | Harvey | 4/328 |
| 680,380 | 8/1901 | Hyde | 137/247.25 X |
| 1,303,974 | 5/1919 | Shadall | 4/215 |
| 3,740,771 | 6/1973 | Bond | 4/215 |
| 3,781,923 | 1/1974 | Maisch et al. | 4/213 |
| 4,011,608 | 3/1977 | Pearson | 4/213 |
| 4,031,574 | 6/1977 | Werner | 4/213 |
| 4,318,192 | 3/1982 | Williams et al. | 4/213 |
| 4,590,629 | 5/1986 | Lusk | 4/213 |
| 4,800,596 | 1/1989 | Menge | 4/348 |

FOREIGN PATENT DOCUMENTS 2114778 8/1979 Fed. Rep. of Germany ..... 4/213

*Primary Examiner*—Henry J. Recla
*Assistant Examiner*—Robert M. Fetsuga
*Attorney, Agent, or Firm*—Peter K. Kontler

[57] ABSTRACT

A flushing tank for a toilet has a housing which accommodates a body of flushing water. An evacuating unit is disposed in the flushing water and includes a flushing valve, a vertical tubular member whose lower end constitutes part of the flushing valve and a vertical suction pipe for the removal of foul odors from the toilet. The upper end of the suction pipe is connected to the upper end of the tubular member while the lower end of the suction pipe communicates with a filter or with a line which conducts foul odors away from the toilet. A suction generating unit draws foul air into and through the suction pipe. The tubular member is movable up-and-down to open and close the flushing valve. The evacuating unit is mounted in an opening in the bottom of the housing and the opening is connected to the toilet bowl. The flushing water flows through the flushing valve and the opening into the toilet bowl when the flushing valve is opened.

147 Claims, 12 Drawing Sheets 12
75
130
9
124
119
118
117
120
1
10
11
28
313
42
182
131
30
13
7
5
25
4
26
27
38

62
204
9
66
64
63
76
198
99
99
106
67
82
68
197
29
30
42
52
199
202
200
15
13
203
7
201
31
20
312

FLUSHING TANK FOR USE WITH TOILET BOWLS

BACKGROUND OF THE INVENTION

The invention relates to a flushing tank for toilet flushing. The flushing tank has a water drain which establishes a connection to a toilet bowl and is controlled by a flushing valve. The flushing valve has an extension which extends through a flushing water supply above the flushing valve. Foul air is sucked out of the toilet bowl by a suction generator.

Although they function very well, such flushing tanks have not been successful in practice because the combination of a flushing valve with a suction device for sucking foul air from the toilet bowl is too complicated. The combination of these two functions led to commercial designs in which a large number of pipes were disposed inside the housing of the flushing tank. This piping was too intricate for commercial installation, on the one hand, and too bulky for reception of a flushing water supply, on the other hand. Flushing tanks equipped in this manner either could not accept sufficient flushing water or became so large that they could no longer be used in modern bathrooms.

SUMMARY OF THE INVENTION

It is accordingly an object of the present invention to so improve a flushing tank of the above type that it can be easily installed and has relatively small dimensions while allowing an optimum combination of flushing and suction functions to be obtained.

According to the invention, this object is achieved in that a suction pipe connected with the suction generator extends through the flushing water. On the one hand, the upper end of the suction pipe facing away from the flushing valve is connected with the extension. On the other hand, the suction pipe leads to at least one deodorizer which receives the foul air sucked out of the toilet bowl. The flushing valve, together with the extension and the suction pipe, forms a discharge fitting which extends through a housing for the flushing water supply and is fixed in an opening leading out of the housing.

This flushing tank allows the toilet flushing function and the foul air suction function to be optimally combined. It has only two pipes which extend through the flushing water supply. Of these, one serves both for actuation of the flushing valve and suction of the foul air while the other establishes the connection to the deodorizer. Depending upon the specific characteristics of the installation, this deodorizer can be in the form of either a filter which absorbs the foul air or a foul air system into which the foul air is conveyed. The foul air system can, for example, be connected with a plurality of toilet bowls whose foul air is removed by the system. However, it is also possible to select a waste water system as the foul air system and to carry out a general removal of waste water by means of the waste water system. If the foul air is removed via the waste water system, an odor trap is provided in the flushing tank in addition to the two pipes which respectively constitute the extension of the flushing valve and the suction pipe. The odor trap prevents the odor-laden atmosphere which is generated in the waste water system from penetrating into the toilet bowl.

A great advantage of combining the extension and the suction pipe into a discharge fitting is that the discharge fitting can be easily installed in the housing of the flushing tank and aligned in the desired position. This discharge fitting makes it necessary to have only a single sealing location inside the flushing tank and the sealing location can be produced relatively easily and inexpensively. The flushing tank also remains easily understood by the layman and can thus be installed, as well as disassembled and reassembled if necessary, without great expense. A discharge feed pipe projects from the flushing tank and subsequent corrections in the position of the discharge feed pipe relative to the flushing tank, on the one hand, and to a waste water system connection, on the other hand, are readily possible by rotation of the discharge fitting within the opening.

In accordance with a preferred embodiment of the invention, the suction pipe is guided inside the extension. This results in the most noticeable space savings for the suction pipe which conducts the foul air. To create sufficient room for the suction pipe, it is only necessary to dimension the extension appropriately. Moreover, the difference in size between the extension and the suction pipe can be relatively small because the annular space produced by the size difference is sufficient for removal of the foul air. The flushing water leaves the flushing tank only in the region of the flushing valve. In order to open the flushing valve, the lower end of the extension facing the flushing valve is formed as a valve part which cooperates with a valve seat. When the flushing valve is open, the flushing water flows between the valve part and the valve seat in a direction towards the toilet bowl. Since the flushing water does not pass through the extension during flushing of the toilet, the cross section of the extension is not determined by the amount of flushing water.

Furthermore, a connection between the suction pipe and the extension can be readily established when the suction pipe is guided inside the extension. This connection can be established, for instance, by means of a bell which surrounds the extension as well as the suction pipe guided therein. The outer edge of the bell is immersed in a body of water so that foul air conducted through the extension can be removed via the suction pipe without the escape of foul air from the bell.

In an additional preferred embodiment of the invention, the suction pipe projects from the water drain externally of the housing. This makes easy installation of the unit possible. Only a single sealing location, which can be readily sealed with respect to the opening through the bottom of the housing, is then present in such bottom.

According to a further preferred embodiment of the invention, the odor trap required upon connection to the waste water system is constituted by a water barrier vessel which can be filled with a portion of the flushing water supply. In this manner, a water barrier contained in the water barrier vessel can be used for flushing purposes. The water barrier vessel can be formed at the upper end of the extension. This construction of the water barrier vessel has the great advantage that the latter can be compact and can be held in the flushing tank by structurally simple means. It takes up little space in the housing and, in simple fashion, prevents the foul atmosphere generated in the waste water system from penetrating into the toilet bowl. It can be rapidly emptied when a connection must be established between the waste water system and the suction pipe for the purpose of foul air removal.

In accordance with another preferred embodiment of the invention, the flushing valve opens for intervals of different length depending on the desired quantity of flushing water. This makes it possible to preselect the amount of flushing water required for the respective flushing purpose. In many cases, a quantity of flushing water substantially smaller than the total contents of the flushing tank suffices for flushing. A relatively short open interval for the flushing valve can be sufficient in these cases and only a relatively small amount of flushing water then flows from the flushing valve towards the toilet bowl during this short open interval.

The control for the flushing valve advantageously includes a float control which is dependent upon the desired quantity of flushing water. By means of a float which descends in the flushing tank as flushing water flows out, the opened flushing valve is held open for a longer or shorter period in accordance with the particular choice.

To this end, the float is constructed as a buoyant body operating on a valve part via an extension which guides the float. The specific weight of the float is such that it has a buoyant force sufficient to again close the flushing valve with the desired speed. A float housing can be associated with the float and, like the float, surrounds the discharge fitting circumferentially. A residual quantity of the flushing water which flows out of the housing through the flushing valve accumulates in this float housing. The float sinks in the desired manner with this residual water so that control of the closing speed of the flushing valve is insured even when the predominant part of the flushing water has left via the flushing valve.

BRIEF DESCRIPTION OF THE DRAWINGS

Additional features of the invention will be apparent from the following detailed description in conjunction with the accompanying drawings which illustrate preferred embodiments of the invention by way of example.

In the drawings.

DESCRIPTION OF THE PREFERRED EMBODIMENTS

Figure 1:
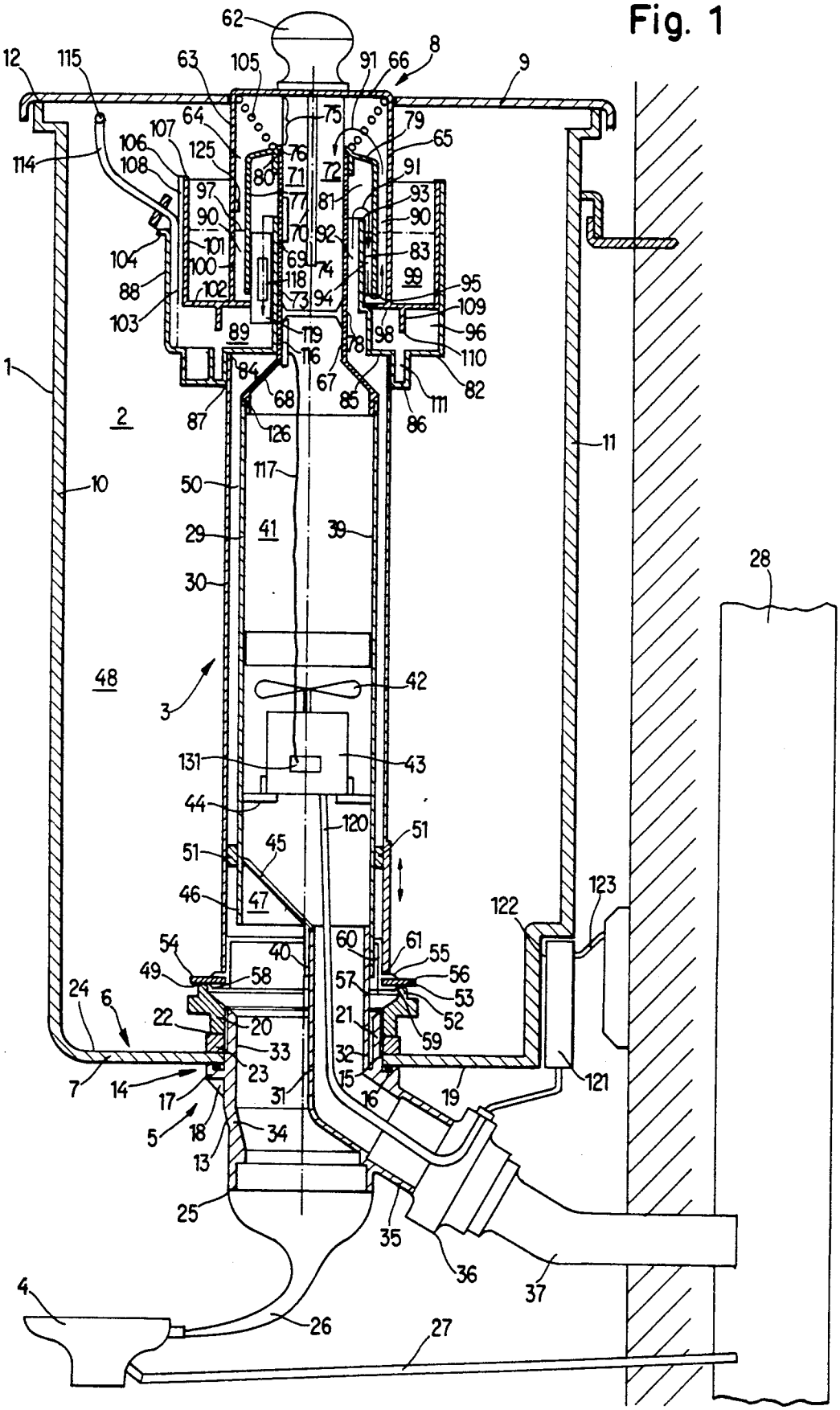
FIG. 1 is a section through a flushing tank which is mounted on a wall and connected to a toilet bowl and a waste water system.

A flushing tank (FIGS. 1 and 2) consists essentially of a housing 1 and a discharge fitting 3 extending through the interior chamber 2 thereof. The lower portion 5 of the discharge fitting 3, which faces a toilet bowl 4, is guided in a bottom 7 which closes the housing 1 at the underside 6 of the latter confronting the toilet bowl 4. The upper portion 8 of the discharge fitting 3 facing away from the lower portion 5 is guided in a cover 9 of the housing 1 which closes the interior chamber 2. The housing 1 is bounded by walls 10,11 having upper ends 12 which face away from the bottom 7, and the cover 9 rests on and clamps the upper ends 12.

The discharge fitting 3 has a discharge feed pipe 13 which extends through the bottom 7. The discharge feed pipe 13 is sealed with respect to an opening 15 in the bottom 7 by means of a sealing system 14. The sealing system 14 is in the form of an O-ring 16 which extends through a receptacle 17. The receptacle 17 is affixed to an outer surface 18 of the discharge feed pipe 13 projecting out of the housing 1. When the discharge feed pipe 13 extends through the opening 15 into the interior chamber 2 of the housing 1, the O-ring 16 lies firmly against an outer surface 19 of the bottom 7 which faces the O-ring 16. The discharge feed pipe 13 is fixed in the opening 15 by means of a nut 20. The inner thread of the nut 20 is screwed onto an outer thread 21 provided on the outer surface 18 which projects into the interior chamber 2. The lower end 22 of the nut 20, which faces the bottom 7, can bear against a spacer ring 23 which rests on an inner surface 24 of the bottom 7 facing the interior chamber 2.

The discharge feed pipe has a lower end 25 which projects from the housing 1 and the lower end 25 is connected to the toilet bowl 4 via a suction line 26. Furthermore, the toilet bowl 4 is connected to a waste water system 28 by means of a waste water line 27. The waste water is conducted into a non-illustrated sewer system through the waste water system 28.

A suction pipe 29 is guided inside the discharge feed pipe 13 and is concentrically surrounded by a tubular extension 30 with which it forms a principal part of the discharge fitting 3. The suction pipe 29 has a connecting section 31 extending eccentrically through the discharge feed pipe 13 and is fast with the latter. The connecting section 31 can have a wall 32 which, in the region thereof closest to the discharge feed pipe 13, is identical to an inner wall 33 of the discharge feed pipe 13 facing the connecting section 31. The connecting section 31 is conducted out of the discharge feed pipe 13 and a connecting end portion 35 of the connecting section 31 passes through the wall 34 of the discharge feed pipe 13 in a region outside of the interior chamber 2. The connecting end portion 35 is fast with the wall 34 and forms a structural unit with the same. The connecting end portion 35 has an end 36 which projects from the discharge feed pipe 13 and the end 36 is connected to a foul air line 37. This can open into the waste water system 28, for example (see FIG. 1). However, it is also possible for the foul air line 37 to open into into a foul air filter 38 (see FIG. 2).

The suction pipe 29 has a principal part 39 which extends approximately vertically through the housing 1 and is connected to the connecting section 31 by a plug connection 40. The principal part 39 has a substantially greater diameter than the connecting section 31. A suction generator 42 and its drive 43 are mounted on a console 44 in an inner chamber 41 enclosed by the principal part 39. An inclined bottom 45 of the principal part 39 extends towards the plug connection 40 which opens into the principal part 39 eccentrically. A skirt 46 of the suction pipe 29 projects beyond the inclined bottom 45 and a pocket 47 is formed between the skirt 46 and the inclined bottom 45. This pocket 47 constitutes a receptacle for flushing water 48 which is sprayed upwards against the suction pipe 29 after opening of a flushing valve 49 formed on the nut 20. Furthermore, coulisses 51 can be disposed in a gap 50 between the suction pipe 29 and the extension 30 in order to reduce the cross section of the gap 50. Such coulisses can be distributed over the entire length of the gap 50 on either the suction pipe 29 or the extension 30 to prevent flushing water 48 from being sprayed upwards in the gap 50 after opening of the flushing valve 49.

The flushing valve 49 includes a valve seat 52 which is formed on the nut 20. This valve seat 52 is contacted by a vertically movable valve part 53 having a seal 54 which, in the closed position of the flushing valve 49, lies on the valve seat 52. The seal 54 is guided in a seal seat 55 inside the valve part 53. The seal 54 has an outer portion 56 which projects from the seal seat 55 and rests on the valve seat 52 at the location where the outer portion 56 extends out of the seal seat 55. The valve part 53 has a lower portion 57 which extends beneath the seal seat 55 and the lower portion 57 can project into an inner chamber enclosed by the valve seat 52. The lower portion 57 has a conical outer surface 58 whose slope equals that of a corresponding conical inner surface 59 which causes the valve seat 52 to be raised above the nut 20. When the seal 54 has reduced elasticity, the two conical surfaces 58,59 are in engagement so that deformation of the seal 54 is held within limits determined by the spacing of the two conical surfaces 58,59 from one another. In addition, this design of the flushing valve 49 insures that the overall length of the discharge fitting 3 only changes within narrow limits.

The extension 30 has an end 61 which faces the valve part 53 and the valve part 53 is fixed to the end 61 via a plug connection 60. By lifting the extension 30, the valve part 53 is lifted away from the valve seat 52 so that the flushing valve 49 is opened and the flushing water 48 can flow out of the interior chamber 2 into the suction line 26 through the open flushing valve 49. The extension 30 is here moved relative to the suction pipe 29.

To this end, the extension 30 is connected with a flushing knob 62 which projects from the cover 9 of the housing 1. A bell 63 is fast with the flushing knob 62 and encloses an inner chamber 64 which establishes a connection between the gap 50 and the inner chamber 41 of the suction pipe 29. The inner chamber 64 is delimited by a largely cylindrical casing part 65 as well as a bell base 66 which lies in approximately the same plane as the cover 9 when the flushing valve 49 is closed. The suction pipe 29 has a constriction 67 which projects into the inner chamber 64 and widens in a direction towards the principal part 39 of the suction pipe 29 via an enlargement 68 shaped like a frustum of a cone. The bell 63 is guided in the constriction 67 by means of a cylindrical unit 69 which extends through the center of the inner chamber 64 in approximate parallelism with the casing part 65. The cylindrical unit 69 consists of at least two vanes 71,72 which extend from a central axis 70 and the outer edges 73,74 of the vanes 71,72 facing away from the central axis are guided in the constriction 67. The flushing knob 62 is secured at the central axis 70.

The constriction 67 ends at a distance 75 from the bell base 66 which is sufficiently large that the bell 63 can be lowered towards the interior chamber 2. Foul air rising in the gap 50 is sucked into the inner chamber 41 of the suction pipe 29 via this spacing 75. An upper end 76 of the constriction 67 projects into the inner chamber 64 of the bell 63 and a circumferential flange 77 is fixed to the upper end 76. The circumferential flange 77 extends through an angle of about 180 degrees. The constriction 67 has an outer surface 78 which faces the circumferential flange 77 and the circumferential flange 77 is approximately parallel to the outer surface 78. The circumferential flange 77 is connected to the upper end 76 by means of an annular connecting piece 79 which is secured to the upper end 76 via a plug connection 80. The connecting piece 79 is in the form of a truncated cone whose surface is slightly inclined towards the circumferential flange 77 so that water drops which may advance towards the upper end 76 can run off towards the circumferential flange 77 over the connecting piece 79 without entering the inner chamber 41.

An approximately cylindrical annular chamber 81 is formed between the constriction 67 and the circumferential flange 77, and an annular inner wall 83 of a water barrier container 82 projects into the annular chamber 81. The water barrier container 82 is fixed to an upper end 84 of the extension 30 facing away from the flushing valve 49. To this end, an annular depression 86 projects from a bottom 85 of the water barrier container 82. The bottom 85 of the water barrier container 82 faces the upper end 84 of the extension 30 and the latter is secured to the outer wall of the depression 86 by means of a plug connection 87.

An annular outer wall 88 of the water barrier container is approximately concentric to the annular inner wall 83 and is fast with the bottom 85. In this manner, the water barrier container 82 defines a container chamber 89 which is bounded by the inner wall 83, the bottom 85 and the outer wall 88. The casing part 65 of the bell 63 projects into the container chamber 89. The diameter of the casing part 65 is such that the circumferential flange 77 extends into the inner chamber 64 of the bell 63 and an annular space 90 remains between the circumferential flange 77 and the casing part 65 of the bell 63. The cross section of the annular gap 90 is sufficiently large that a foul air stream 91 produced by the suction generator 42 can be sucked out of the annular chamber 81 towards the inner chamber 41 of the suction pipe 29.

The foul air stream 91 is sucked out of the gap 50 through an annular chamber 92 which is formed by the annular inner wall 83 and the outer surface 78 of the constriction 67. The annular chamber 92 is in communication with the gap 50. The inner wall 83 has an upper edge 93 which projects into the annular chamber 81 and the foul air stream 91 rising through the annular chamber 92 is deflected at the upper edge 93 and sucked into an annular chamber 94 formed by the inner wall 83 of the water barrier container 82 and the circumferential flange 77 projecting into the water barrier container 82. The circumferential flange 77 has a lower end 95 which projects into the water barrier container 82. In the annular chamber 94, the foul air stream 91 travels to the lower end 95 of the circumferential flange 77 and is there deflected once more into the space 90 bounded by the casing part 65 of the bell 63 and the circumferential flange 77. In the space 90, the foul air stream 91 rises within the bell 63 towards the bell base 66 and, at the upper end 76 of the constriction 67, is deflected towards the inner chamber 41 of the suction pipe 29.

This guidance of the foul air stream 91 presumes that there is no water barrier 96 in the water barrier container 82. When the water barrier container 82 is filled, the water barrier 96 produces an odor trap preventing foul air which comes from the waste water system 28 to the inner chamber 41 via the foul air line 37 from entering the gap 50 and thus the toilet bowl 4. To this end, the water barrier 96 is at such a level 97 when the water barrier container 82 is filled that both the annular chamber 94 and the gap 90 are at least partially filled with the water barrier 96 and the lower end 95 of the circumferential flange 77 projects into the water barrier 96. In the filled condition of the water barrier container 82, no foul air stream 91 can travel between the gap 50 and the inner chamber 41 of the suction pipe 29.

For such a foul air stream 91 to flow through the water barrier container 82, the level 97 of the water barrier 96 must be lowered at least so far that the lower end 95 terminates above a lowered level 98 in the water barrier container 82. Lowering of the level 97 is effected by means of an expelling body 99 which can be lowered in the water barrier container 82 and thereby expel the water barrier 96 in the water barrier container 82 from the latter. To this end, the expelling body 99 has a volume which corresponds to that of the water barrier 96 to be expelled. The expelling body 99 is formed directly on the casing part 65 of the bell 63 and has an essentially U-shaped cross section. The inner leg 100 of the expelling body 99 is constituted by the casing part 65 of the bell 63 and is connected with an outer leg 101, which is generally parallel to the inner leg 100, by a transverse web 102. The transverse web 102 is generally parallel to the bottom 85 of the water barrier container 82 while the outer leg 101 is generally parallel to the annular outer wall 88. A gap 103 is defined between the outer leg 101 and the annular outer wall 88. The water barrier 96 expelled from the water barrier container 82 can rise in the gap 103 and overflow into the interior chamber 2 of the housing 1 over an upper rim 104 bounding the annular outer wall 88. It is further possible for the water barrier 96 to rise in the annular chamber 94 upon lowering of the expelling body 99 and to overflow into the gap 50 over the upper edge 93 of the annular inner wall 83 of the water barrier container 82. The expelled water barrier 96 passes through the gap 50 into the toilet bowl 4 via the suction line 26. By appropriate dimensioning of the annular inner wall 83, on the one hand, and the annular outer wall 88, on the other hand, it is possible to determine whether expulsion of the water barrier 96 will take place in the direction of the interior chamber 2 or in the direction of the gap 50. Depending upon choice, the annular outer wall 88 is made lower than the inner wall 83 or vice versa.

The expelling body 99 is lowered by shifting the bell 63 towards the interior chamber 2. The expelling body 99 then expels the water barrier 96 from the water barrier container 82. Following expulsion of the water barrier 96, the bell 63 is again raised by a spring 105 which bears against the upper end 76 of the constriction 67 and against an inner surface of the bell base 66 facing the inner chamber 64. The spring 105 is in the form of a conical coil spring which operates as a compression spring during return of the bell 63 from its lowered position in the interior chamber 2. If the bell 63 is withdrawn from the interior chamber 2 to a level above that of the cover 9, the spring 105 functions as a tension spring to effect return of the bell 63.

This situation arises when the flushing valve 49 is to be closed once more after being opened. To open the flushing valve 49, the valve part 53 connected to the extension 30 is lifted from the valve seat 52. Lifting of the extension 30 takes place by means of the bell 63. The water barrier container 82 is coupled to the bell 63 via the expelling body 99. To this end, the outer wall 88 of the water barrier container 82 is provided with at least two diametrically opposed coupling portions 106 in the form of projections 107 extending towards the expelling body 99. An upper edge 108 of the outer leg 101 of the expelling body 99 engages underneath the projections 107. When the bell 63, and thus the expelling body 99, is withdrawn from the cover 9, the upper edge 108 engages underneath the projections 107 and thereby lifts the water barrier container 82 as well as the extension 30 which is fixed to the water barrier container 82 by the plug connection 87. In this manner, the valve part 53, which is fast with the extension 30, is lifted from the valve seat 52 so that the flushing valve 49 opens. Subsequently, the bell 63 is again lowered towards the interior chamber 2 and the coupling portions 106 of the water barrier container 82 are uncoupled from the expelling body 99. Due to the weight of the extension 30 which is fixed to the water barrier container B2. The valve part 53 is once more lowered onto the valve seat 52 and accordingly closes the flushing valve 49. A ring 109 projects from the transverse web 102 of the expelling body 99 towards the water barrier container 82. The edge 110 of the ring 109 facing away from the transverse web 102 dips into a residual body of water 111 and thus prevents air from being sucked out of the housing 1 via the gap 103 defined by the outer leg 101 and the annular outer wall 88.

Figure 8:
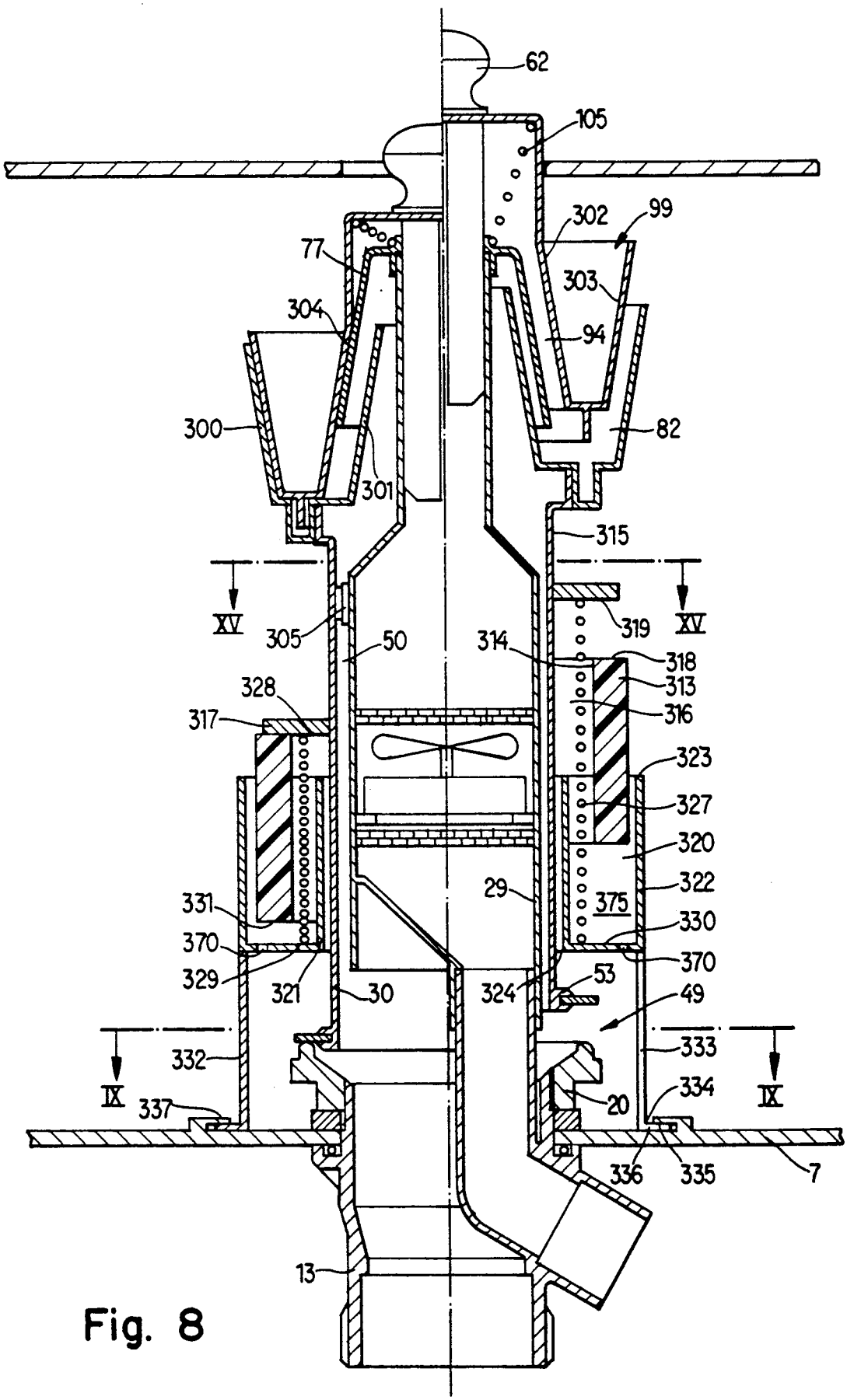
FIG. 8 is a longitudinal section through a discharge fitting having a float housing as well as a water barrier container and an expelling body of conical cross section.
Figure 11:
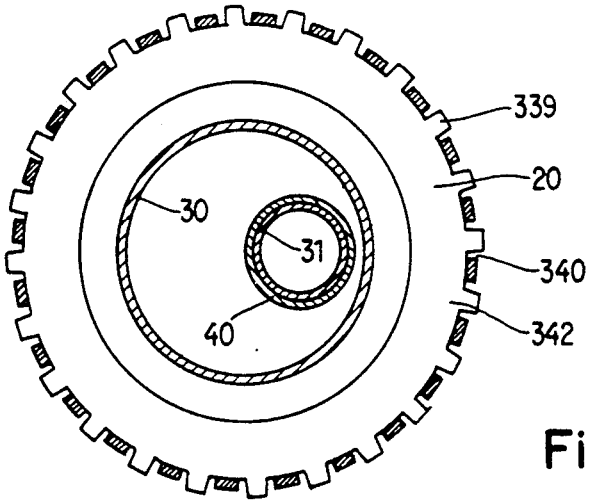
FIG. 11 is a section through a discharge fitting along the section line XI—XI of FIG. 10.

It is also possible to provide the water barrier container 82 with walls 300,301 which, as seen in a cross section of the water barier container 82 (FIG. 8), converge conically towards the flushing valve. Moreover, the walls 302,303 of the expelling body 99 also extend conically towards the flushing valve 49. The walls 302,303 are essentially parallel to the walls 300,301. Finally, the circumferential flange 77 is also constructed as a conical wall 304 which is essentially parallel to the walls 301,303 and projects into the annular chamber 94 between the two walls 301,303. The conical design of the walls 300,301,302,303, 304 has the great advantage that a relatively large portion of the water barrier in the water barrier container 82 is already expelled in response to small movements of the expelling body 99 towards the flushing valve 49. Furthermore, the conical walls 302,303 release relatively easily from the respective neighboring conical walls 300,304 when, after lowering of the expelling body 99, this is again raised under the action of the coil spring 105 to permit air sucked in through the discharge feed pipe 13 to flow towards the suction pipe 29.

Filling of the water barrier container 82 can take place by means of a bypass line 114 (FIG. 1) connecting the water barrier container 82 with a flushing water inlet 115 through which the flushing water 48 is conducted into the interior chamber 2. It is possible to fill the entire interior chamber 2 with flushing water 48 which is first conducted into the water barrier container 82. Once the latter has been filled, the flushing water 48 enters the interior chamber 2 via an overflow of the water barrier container 82.

The drive 43 is controlled by a reed contact 116 which is connected to the drive 43 by means of a control line 117. The reed contact 116 is activated by a magnet 118 which is embedded in a float 119. The float 119 floats in the water barrier container 82. Upon lowering of the water barrier 96 in the water barrier container 82, the float 119 sinks in the water barrier container 82 so that the magnet 118 can activate the reed contact 116. To this end, the reed contact 116 is mounted inside the suction pipe 29 at a height corresponding to the lowered level of the water barrier in the water barrier container 82. After the reed contact 116 has been activated, the drive 43 is supplied with current via a supply line 120 so that the suction generator 42 can start and suck air out of the water barrier container 82. The suction generator 42 pushes the sucked air through the foul air line 37 into the waste water system 28.

Figure 15:
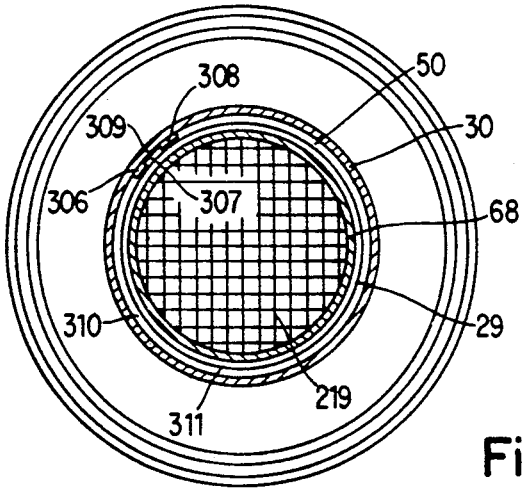
FIG. 15 is a section through a discharge fitting along the section line XV—XV of FIG. 8.
Figure 10:
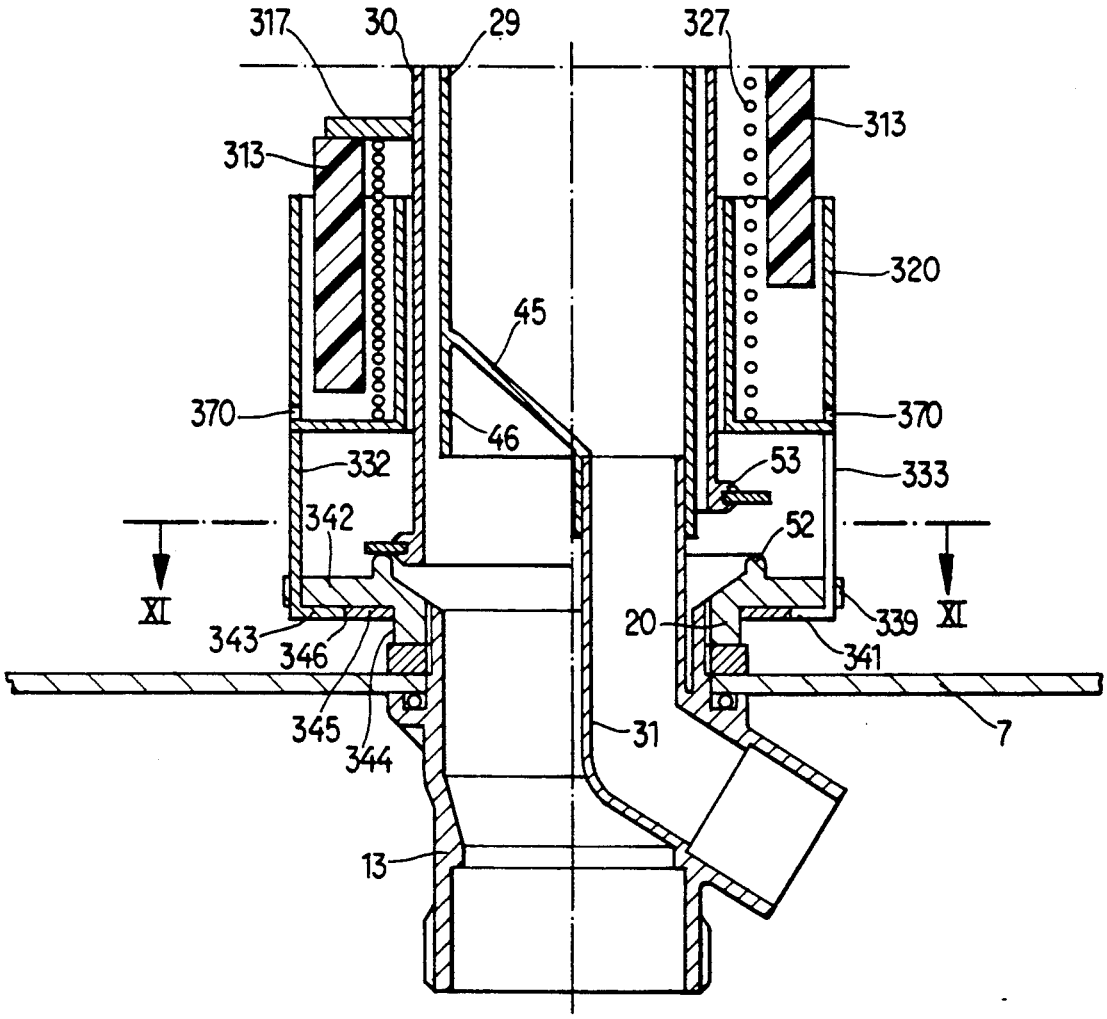
FIG. 10 is a longitudinal section through a lower portion of a discharge fitting, and shows the open and closed conditions of the flushing valve.
Figure 12:
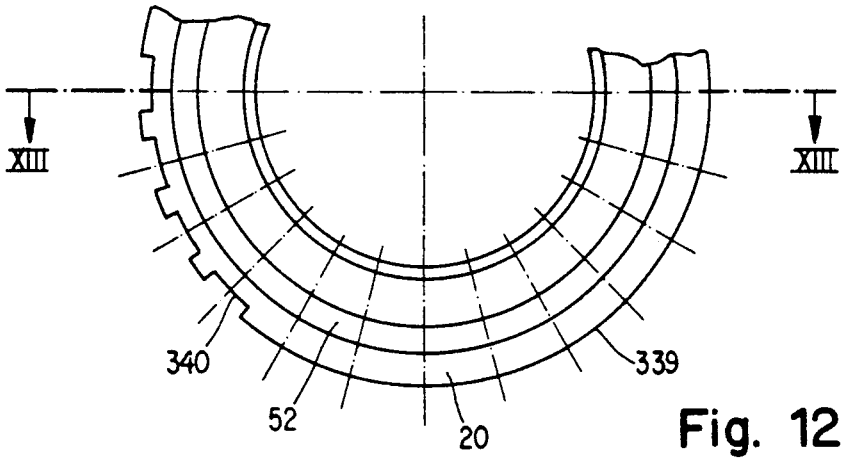
FIG. 12 is a plan view of a nut connecting the discharge feed pipe with the flushing tank.
Figure 13:
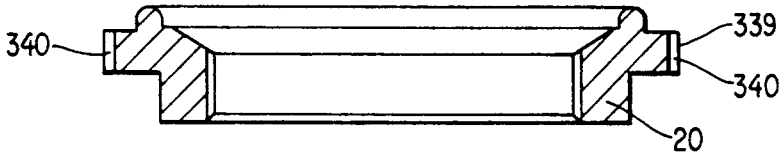
FIG. 13 is a section through the nut along the section line XIII—XIII of FIG. 12.

To assure proper functioning of the reed contact 116, it is not only necessary for the magnet 118, and thus the float 119, to be precisely aligned relative to the reed contact 116 vertically but the reed contact 116 must also lie directly opposite the magnet 118 in the plane passing through the reed contact 116. The float 119 with its enclosed magnet 118 floats in the water barrier container 82 while the reed contact 116 is secured in the suction pipe 29. In order to achieve precise alignment of the water barrier container 82 with respect to the suction pipe 29, an adjusting device 305 (FIG. 8) is provided between the suction pipe 29 and the extension 30 secured to the water barrier container 82. The adjusting device is arranged in the gap 50 between the suction pipe 29 and the extension 30. The adjusting device is in the form of sliding sections 306,307,308 (FIG. 15) which bear against one another and define a space 309. The sliding sections 306,308 are disposed on an inner surface 310 of the extension 30 facing the gap 50 whereas the sliding section 307 is secured to an outer surface 311 of the suction pipe 29 facing the gap 50. A space 309 is provided between the two outer sliding sections 306,308 and has a width corresponding to the width of the sliding section 307. When the extension 30 with the water barrier container 82 secured thereto is placed on the suction pipe 29, the sliding section 307 slides into the space 309 between the two sliding sections 306,308. This orientation assures that the reed contact 116 lies directly opposite the magnet 118 enclosed by the float 119.

The connecting end portion 35 of the suction pipe 29 is connected to the foul air line 37 and the supply line 120 (FIG. 1) can, for example, be guided towards the connecting end portion 35 via the connecting section 31. The supply line 120 extends from the end 36 in an airtight fashion and is conducted towards a box 121 which is secured in a recess 122 provided in the housing 1 for this purpose. The box 121 is connected to the external power grid by a cable 123.

Before the toilet bowl 4 is used, the expelling body 99 is lowered in the water barrier container 82 and expels the water barrier 96 from the water barrier container 82. Consequently, the float 119 sinks in the water barrier container 82 so that the magnet 118 can activate the reed contact 116. The drive 43 thereupon starts so that foul air can be sucked out of the toilet bowl 4 through the gap 50 and the inner chamber 41 of the suction pipe 29.

The spring 105 pushes the bell 63, which was lowered together with the water barrier container 82, back to the starting position in which it is coupled to the water barrier container 82 by means of the coupling portions 106. The bell 63 is pulled through the cover 9 for flushing. The extension 30 is then also lifted together with the water barrier container 82 coupled to the expelling body 99 so that the valve part 53 leaves the valve seat 52. This opens the flushing valve 49 and allows the flushing water 48 to enter the suction line 26. Upon completion of flushing, the extension 30 and the valve part 53 connected thereto sink towards the valve seat 52 so that the flushing valve 49 is closed.

Figure 2:
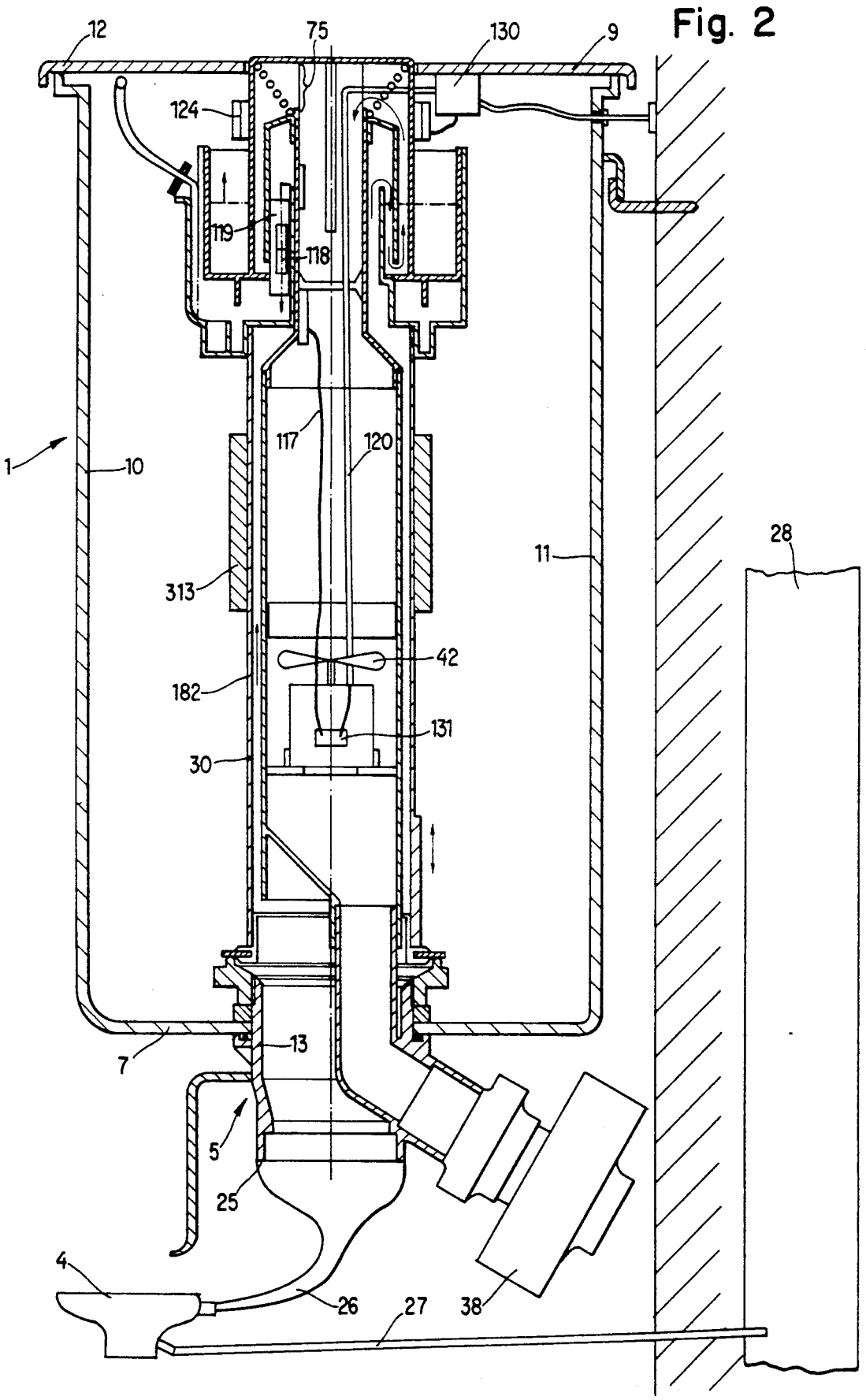
FIG. 2 is a section through a flushing tank which is connected with a foul air filter and a toilet bowl.

It is also possible to activate the bell 63 by means of a lifting magnet 124 (FIG. 2). This mode of activating the bell 63 is preferably employed for flushing tanks which are built into a wall. A box 130 for supplying current to the lifting magnet 124 can be placed below the cover 9 in the housing 1. In this manner, the box 130 can be removed from the housing 1 together with the cover 9.

It is possible to precisely establish the position of the discharge fitting 3, and thus the valve seat 52, relative to the expelling body 99 which is connected to the flushing knob 62. The expelling body 99 can only undergo the movements made by the bell 63. As a result, it is possible that the expelling body 99 with its transverse web 102 will not advance sufficiently in the water barrier container 82 to expel an adequate portion of the water barrier 96 from the water barrier container 82. Since the position of the bell 63 is determined by the cover 9, only the water barrier container 82, together with the extension 30 and the valve seat 52, can be adjusted with respect to the expelling body 99. To this end, the height of the valve seat 52 from the bottom can be varied by placing a larger or smaller number of spacing rings 23 (FIG. 1) between the nut 20 and the bottom 7. If the expelling body 99 with its transverse web 102 cannot be lowered to the full depth of the water barrier container 82, then the water barrier container 82 must be raised towards the cover 9 by means of an additional spacing ring 23.

Figure 16:
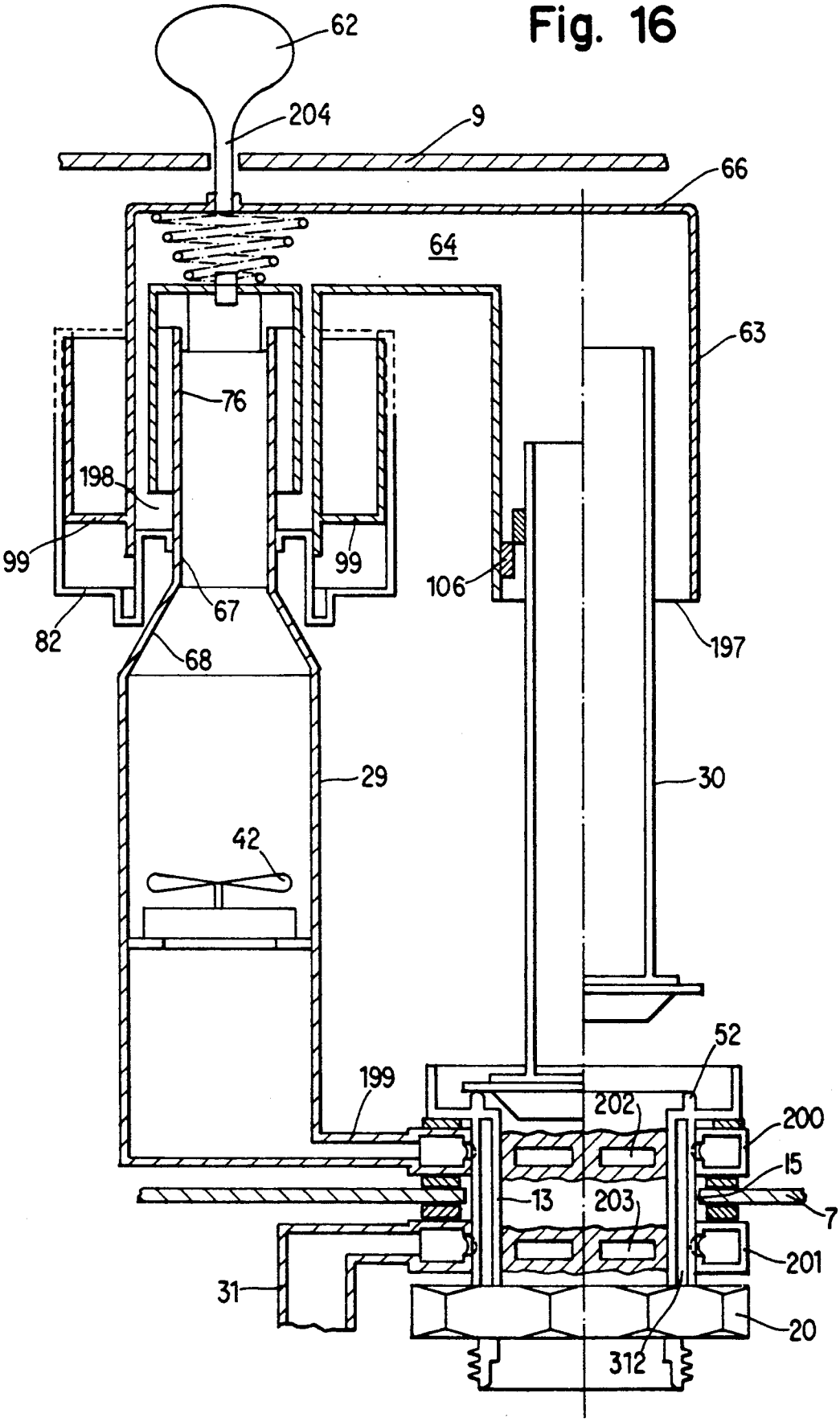
FIG. 16 shows a discharge fitting having a different structure.

In the event that the suction pipe 29 is not guided within the extension 30, the bell 63, which can be basically retained, must have a different design (FIG. 16). It is provided with two inlets 197,198 below the bell base 66, one for the extension 30 and the other for the suction pipe 29. The expelling body 99, which projects into the water barrier container 82, can nevertheless be coupled to the bell 63.

The valve seat 52 is secured to the discharge feed pipe 13 which extends through the bottom 7 of the housing 1. The discharge feed pipe 13 is surrounded by an annular chamber 312 (FIG. 16) and the suction pipe 29 opens into the annular chamber 312 via a connecting line 199 and the connecting section 31. The connecting section 31 is connected to the waste water line 27. The connecting line 199 and the connecting section 31 include respective rings 200 and 201 having inlet openings 202 and 203 which open into the annular chamber 312. The latter extends through the opening 15 in the bottom 7 together with the discharge feed pipe 13 and is fixed to the bottom 7 of the housing 1 by means of the nut 20.

The bell 63 and the expelling body 99 connected thereto are mounted in the housing 1 for sliding movement in the direction of the suction pipe 29. An activating rod 204 (FIG. 16) for activating the expelling body 99 extends through the cover 9 and a flushing knob 62 can be affixed to the end of the activating rod 204 which projects from the cover 9. The extension 30 is coupled to the bell 63 in the region of the inlet 197 by means of a coupling 106 so that the flushing valve 49 can be opened by lifting the bell 63.

When the flushing valve 49 is closed (FIG. 16), the suction generator 42 fixed in the suction pipe 29 sucks the foul air through the discharge feed pipe 13 which is connected to the toilet bowl 4 via the suction line 26. The foul air enters the inner chamber 64 of the bell 63 through the extension 30 and is sucked into the suction pipe 29 via the water barrier container 82 which has been emptied of the water barrier. From there, the foul air travels through the connecting line 199 into the ring 200 and enters the annular chamber 312 via the inlet openings 202. The foul air travels from here through the inlet openings 203 and into the ring 201 and is pushed from the latter towards the connecting section 31. The connecting section 31 is, for instance, connected to the waste water system 28 which receives the foul air.

Figure 4:
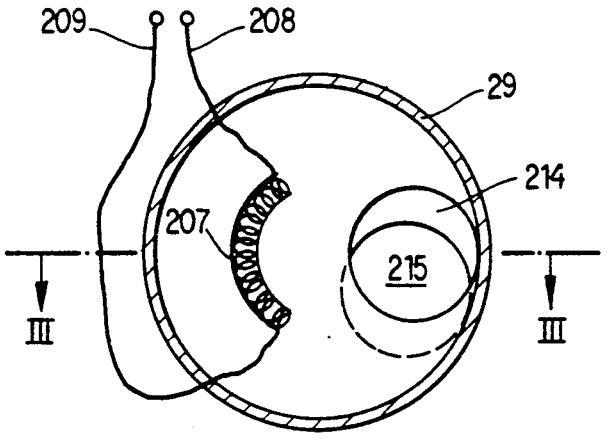
FIG. 4 is a section through a discharge fitting along the section line IV—IV of FIG. 3.
Figure 3:
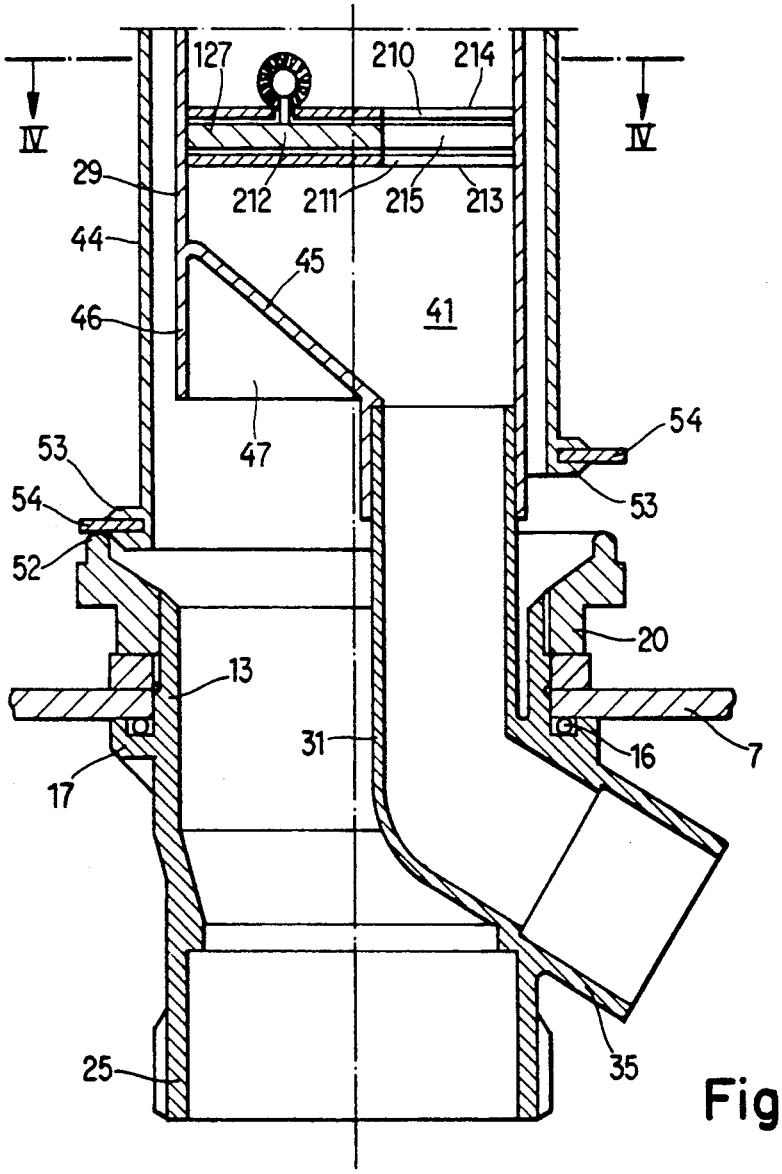
FIG. 3 is a section through a lower portion of a discharge fitting with a solenoid valve as seen along the section line III—III of FIG. 4.

An odor trap can also be produced by other means capable of segregating the inner chamber 41 of the suction pipe 29 from the waste water system 28. For example, a solenoid valve 127 (FIG. 3) can be provided for this purpose in the inner chamber 41 of the suction pipe 29. The solenoid valve 127 can have its own electromagnet 207 (FIG. 4) which is regulated via electrical conductors 208,209. A closure plate 212 which is guided in an airtight fashion between two cover plates 210,211 and is pivotally mounted between the two cover plates 210,211 is connected with the electromagnet 207. Bores 213 and 214 extend through the respective cover plates 210 and 211 and have cross sections which approximate that of the connecting section 31. In the open position of the solenoid valve 127, a bore 215 extending through the closure plate 212 is in register with the two bores 213,214 so that a connection exists between the inner chamber 41 and the waste water system 28. To close the solenoid valve 127, the closure plate 212 is pivoted between the two cover plates 210,211 by the electromagnet 207 until the closure plate 212 closes the two bores 213,214.

Furthermore, a solenoid valve 128 (FIG. 5) can also be provided at the end 36 of the suction pipe 29. The solenoid valve 128 can be designed as a conventional solenoid valve which regulates flow. It is located in the foul air line 37 and seals the latter from the inner chamber 41 of the suction pipe 29 when the suction generator 42 is shut off. It closes a stop 129 provided at the end 36 of the connecting section 31 so that the inner chamber 41 is sealed in a gastight fashion from the waste water system 28.

The solenoid valves 127,128 can be regulated in synchronism with the suction generator 42. To this end, a relay arrangement 131 (FIG. 1), which controls the drive 43 as well as the solenoid valves 127,128, can be provided in the suction pipe 29. It is possible to carry out the regulation by means of the reed contact 116.

To guarantee frictionless functioning of the reed contact 116, the reed contact 116 must be precisely aligned with reference to the magnet 118 which activates the same. To this end, it is possible to provide a plug connection 126 (FIG. 1) at the transition from the principal part 39 of the suction pipe 29 to the enlargement 68 of the constriction 67. The enlargement 68 and constriction 67 can be rotated relative to the principal part 39 within this enlargement so that precise alignment of the reed contact 116 with respect to the magnet 118 enclosed by the float 119 can be achieved.

Figure 6:
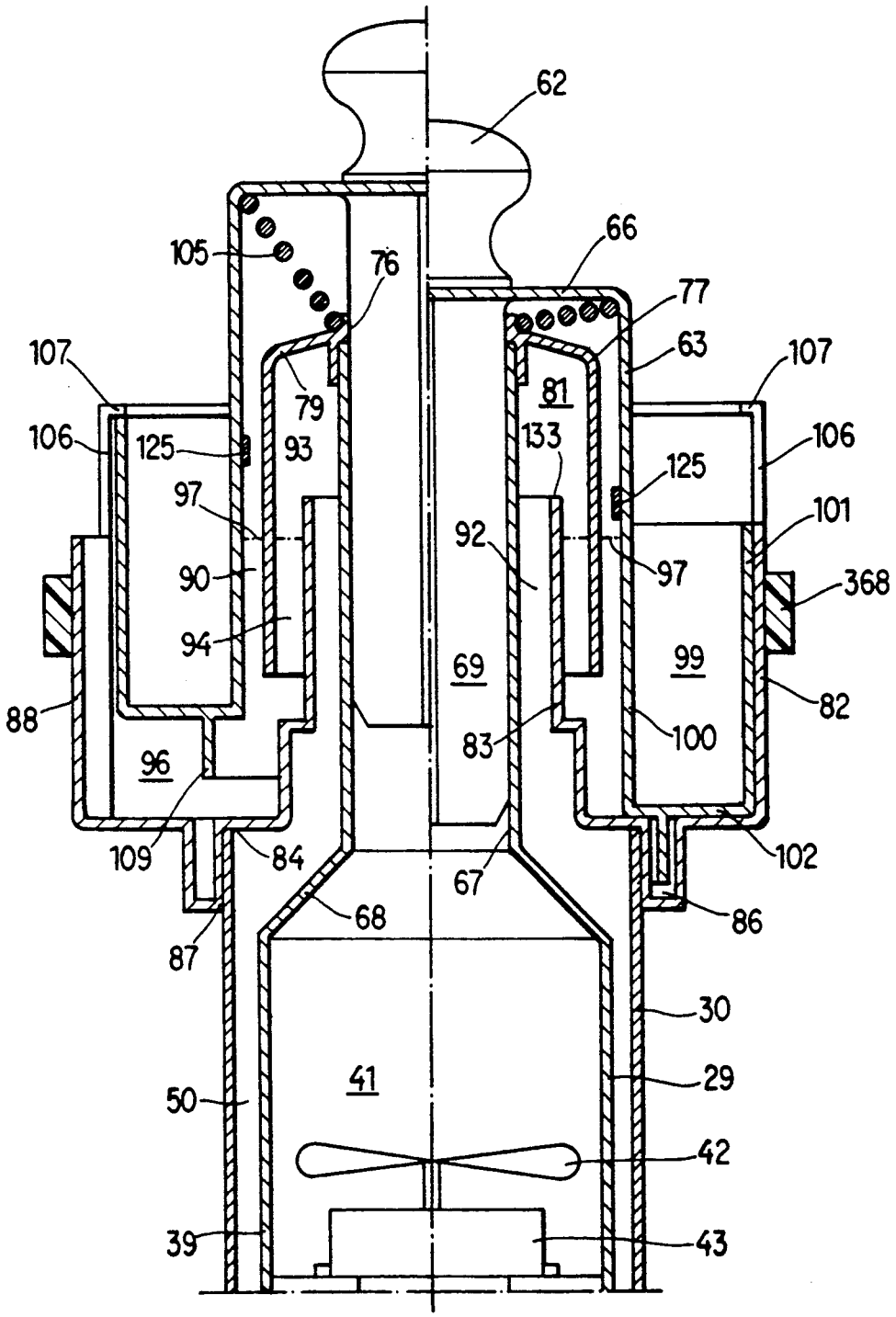
FIG. 6 is a longitudinal section through an upper portion of a discharge fitting, and shows the lowered position of the expelling body as well as the closed condition of the flushing valve.
Figure 7:
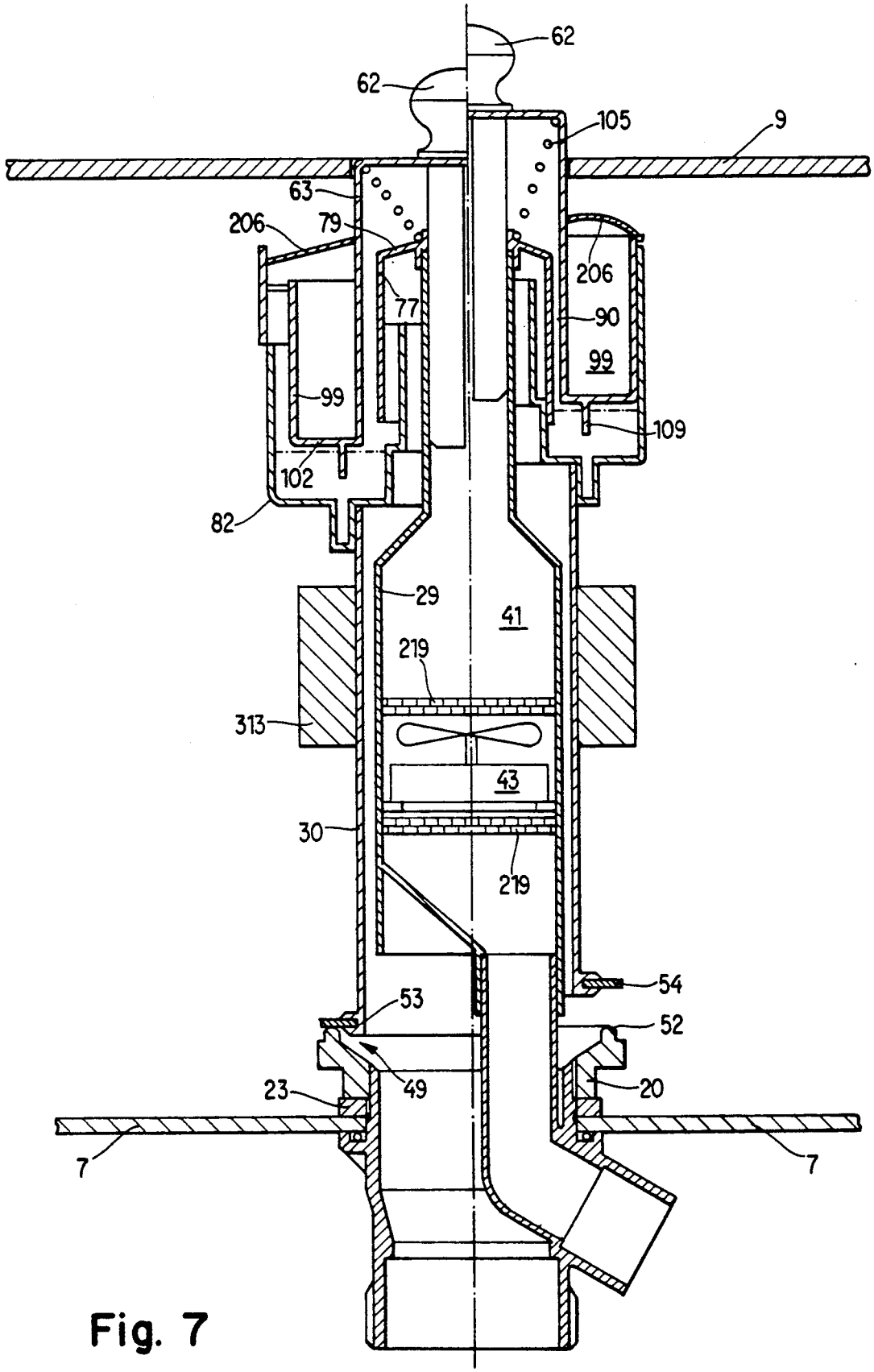
FIG. 7 is a longitudinal section through a discharge fitting, and shows the open and closed condition of the flushing valve, as well as lowered water level in the water barrier container.

When the level 97 of the water barrier 96 in the water barrier container 82 is lowered, the expelling body 99 may cause the water barrier 96 to rise in the gap 90 thereby producing the danger that the water barrier 96 will flow into the inner chamber 41 and towards the suction generator 42. To prevent this, barriers 125 (FIGS. 1 and 6) are disposed in the gap 90. The barriers 125 may be provided on the inner wall of the casing part 65 of the bell 63 or on an outer wall of the circumferential flange 77 which faces the gap 90. The barriers 125 may be in the form of at least one ring or several ring, segments, and may extend through the gap 90 in such a manner that rising of the water barrier 96 in the gap 90 is prevented while sufficient free space remains for the sucking of foul air out of the water barrier container 82 and towards the inner chamber 41 of the suction pipe 29.

To facilitate outflow of the water barrier 96 from the water barrier container 82, an overflow 133 (FIG. 6) can be provided at the annular inner wall 83 of the water barrier container 82. The upper edge 93 of the annular inner wall 83 can be depressed in the region of the overflow 133. Upon lowering the expelling body 99, the expelled portion of the water barrier 96 overflows into the extension 30 via the overflow 133 and flows through the extension 30 towards the toilet bowl 4.

The flushing valve 49 can be regulated by means of an annular float 313 )FIGS. 2, 7, 8, 10) which annularly surrounds the extension 30. The float 33 has an inner surface 314 which faces the extension 30 while the extension 30 has an outer surface 315 which confronts the inner surface 314. A clearance 316 is provided between the inner surface 314 and the outer surface 315 so that the float 313 can be readily moved with reference to the extension 30 along the outer surface 315 thereof. The float 313 is coupled to the extension 30 by a clamping ring 317. The clamping ring 317 clamps the outer surface 315 so that, depending upon the anticipated control of the extension 30 by the float 313, the clamping ring 317 can be adjusted higher or lower on the outer surface 315.

The float 313 has an upper surface 318 which faces the flushing knob 62 while the clamping ring 317 has a lower surface 319 which faces the flushing valve 49. The upper surface 318 of the float 313 floating in the flushing water bears against the lower surface 319 of the clamping ring 317. In this manner, the float 313 floating on the flushing water lifts the extension 30 via the clamping ring 317 during flushing thereby opening the flushing valve 49.

The clamping ring 317 can be secured to the outer surface 315 of the extension 30 in an upper position which is relatively far removed from the flushing valve 49. In this upper position, the float 313 causes the flushing valve 49 to open for a relatively short time as compared to a lower position of the clamping ring 317.

The float 313 has a buoyant force which is smaller than that of the movable part of the discharge fitting 3 connected to the extension 30. This causes the open flushing valve 49 to close once again due to the weight of the movable part. Opening of the flushing valve 49 is a function of the buoyant force of the float 313 and the location at which the clamping ring 317 is secured to the extension 30. Depending upon the water capacity of the toilet bowl 4, the buoyant force of the float 313 can be such that the amount of flushing water which issues from the flushing valve 49 is, for instance, either 6 liters or 9 liters.

To assure uniform control of the flushing water issuing from the flushing valve 49 until such time as the housing 1 is completely empty, a float housing 320 is provided in the lower region of the extension 30 but above an upper position reached by the valve part 53 when the flushing valve 49 is open. The float 313 extends into the float housing 320 after a substantial portion of the flushing water has left the housing 1 through the flushing valve 49. The float housing 320 has an upper edge 323 which faces the flushing knob 62. Since the inner chamber 325 of the float housing 320 is separated from the interior chamber 2 of the housing 1 by an inner wall 321 and an outer wall 322 of the float housing 320, flushing water remains in the float housing 320 even when the level of flushing water in the interior chamber 2 has fallen below the upper edge of the float housing 320. In this manner, the float 313 develops a constant buoyant force independently of the level of flushing water in the interior chamber 2.

The float housing 320 annularly surrounds the discharge fitting 3. A gap 324 is provided between the inner wall 321 and the outer surface 315 of the extension and is large enough that the extension 30 can move longitudinally without being affected by the float housing 20. The inner chamber 325 extends between the outer wall 322 and the inner wall 321 and is sufficiently large to receive the float 313. A housing bottom 330 faces the flushing valve 49 and a coil spring 327 extends through the inner chamber 325 and has an upper end 328 which bears against the clamping ring 317 and a lower end 329 which bears against the housing bottom 330. The coil spring 327 has a small prestress, and the buoyant force of the float 313 combined with the prestress suffices to open the flushing valve 49 even when only a small opening force is applied to the flushing knob 62. On the other hand, the weight of the movable part of the discharge fitting 3 is sufficient to close the flushing valve 49 against the stress of the coil spring 327. The closing speed is regulated by the stress which exists in the coil spring 327 under the action of the float 313.

The height of the housing bottom 330 above the bottom 7 of the housing 1 is at least so great as to assure unimpeded closing of the flushing valve 49. In this regard, when the flushing valve 49 is firmly closed, a safety spacing must exist between the housing bottom 330 and a lower edge 331 of the float 313 which projects into the inner chamber 325. The float housing 320 is emptied by means of discharge openings 370 which are located in the housing bottom 330 or the immediate vicinity thereof. The sizes of the discharge openings 370 control the outflow rate and thereby the closing speed of the flushing valve 49.

The float housing 320 is supported on the bottom 7 of the housing 1. To this end, at least three legs 332,333 are approximately uniformly distributed about the periphery of the float housing 320. The legs 332,333 are elastically secured to the float housing 320 as considered in a direction towards the discharge fitting 3 so that, when subjected to an appropriate force, they are capable of moving towards and away from the discharge fitting 3.

The legs 332,333 have ends 334 which are remote from the float housing 320 and the ends 334 are supported on the bottom 7 of the housing 1. In this connection, pockets are provided on the bottom 7 and have openings 335 which extend towards the discharge fitting 3. Each leg has an end portion 336 which is bent away from the discharge fitting 3 and each of the end portions 336 engages in a respective opening 335.

Figure 9:
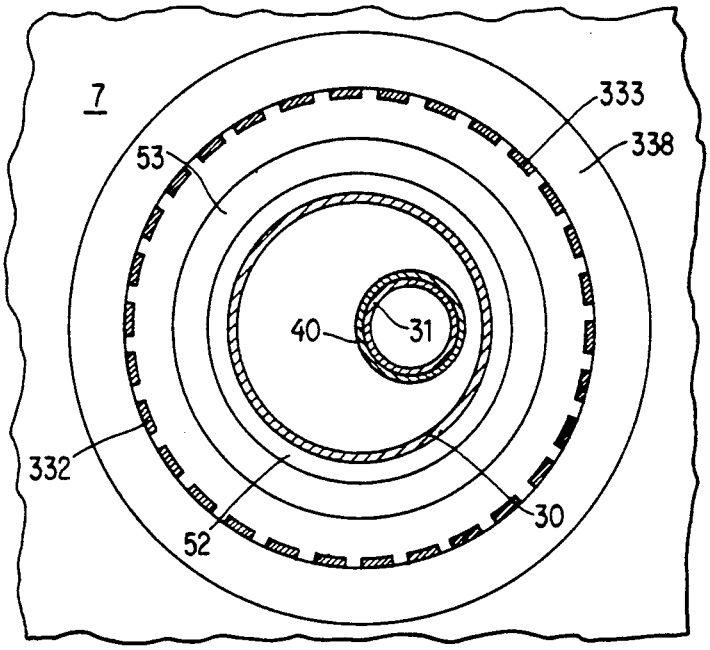
FIG. 9 is a section through a discharge fitting along the section line IX—IX of FIG. 8.

The pockets are constructed as holding portions which are affixed to the bottom 7. The holding portions are provided with hook-like top sections 337 which are directed towards the discharge feed pipe 13. The end 336 of a leg 332,333 engages beneath a respective top section 337 when the leg 332,333 is in its undeflected starting position. To release the float housing 320 from the bottom 7, the legs 332,333 are elastically bent towards the discharge fitting 3 so that the ends 336 are disengaged from the hook-like top sections 337. The entire float housing can then be removed from the interior chamber 2 of the housing 1. The pockets 334 can be in the form of a collar 338 (FIG. 9) which concentrically surrounds the flushing valve 49 and has a hook-like top section in engagement with a plurality of legs 332,333.

Figure 14:
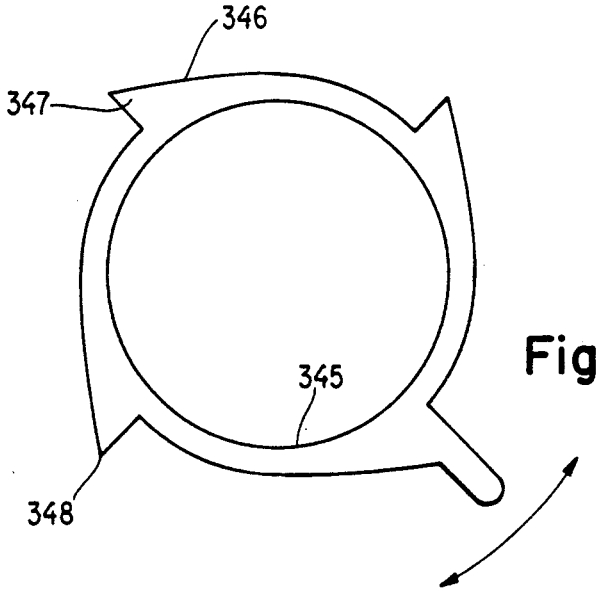
FIG. 14 is a plan view of a mounting ring rotatably mounted on the discharge feed pipe.

The float housing 320 can also be adjustable with respect to the nut 20 which secures the discharge feed pipe 13 to the bottom 7 of the housing 1. In this case, the outer periphery 339 of the nut 20 (FIGS. 10, 11, 12, 13) has uniformly distributed receiving slots 340 and a respective leg 332,333 of the float housing 320 is anchored in each of the slots 340. The receiving slots 340 extend from the outer periphery 339 of the nut 20 towards the discharge feed pipe 13. A collar 342 is formed on the nut 20 and has an underside 343 which faces the bottom 7. The legs 332,333 have bent ends 341 and, when the legs 332,333 are locked in the receiving slots 340, the bent ends 341 engage the collar 342 from below at its underside 343. Accordingly, it is necessary to bend the elastic legs 332,333 away from the discharge fitting 3 in order to lift them away from the nut 20. To facilitate release of the legs 332,333 from the collar 342, a bearing location 344 is provided on the nut 20 below the collar. A rotary ring 345 is mounted on the bearing location 344 for rotation on a central axis extending through the discharge fitting. The rotary ring has an asymmetrical outer periphery 346 (FIG. 14). Protuberances 347 project from the outer periphery 346 towards the legs 332,333 and each protuberance 347 has an outermost point 348 at the location thereof most remote from the center line. Upon rotation of the rotary ring 345 about its central axis, the outermost point 348 of each protuberance contacts a respective leg 332,333 and pushes it out of the corresponding receiving slot 340. The float housing 320 can be lifted away from the nut 20 when the legs 332,333 have been pushed out of the receiving slots 340.

When collector motors are used for the drive 43, sparking at the collector can cause the foul gases in the waste water line 27, and thereby in the waste water system 28, to explode. To limit such explosions to the smallest possible area, safety grids 219 (FIG. 15) are provided at least below the drive 43. Upon detonation of flammable gases, the grids 219 function in the same manner as the grids of a miner's lamp. Such safety grids 219 are advantageously provided on both sides of the drive 43.

Figure 17:
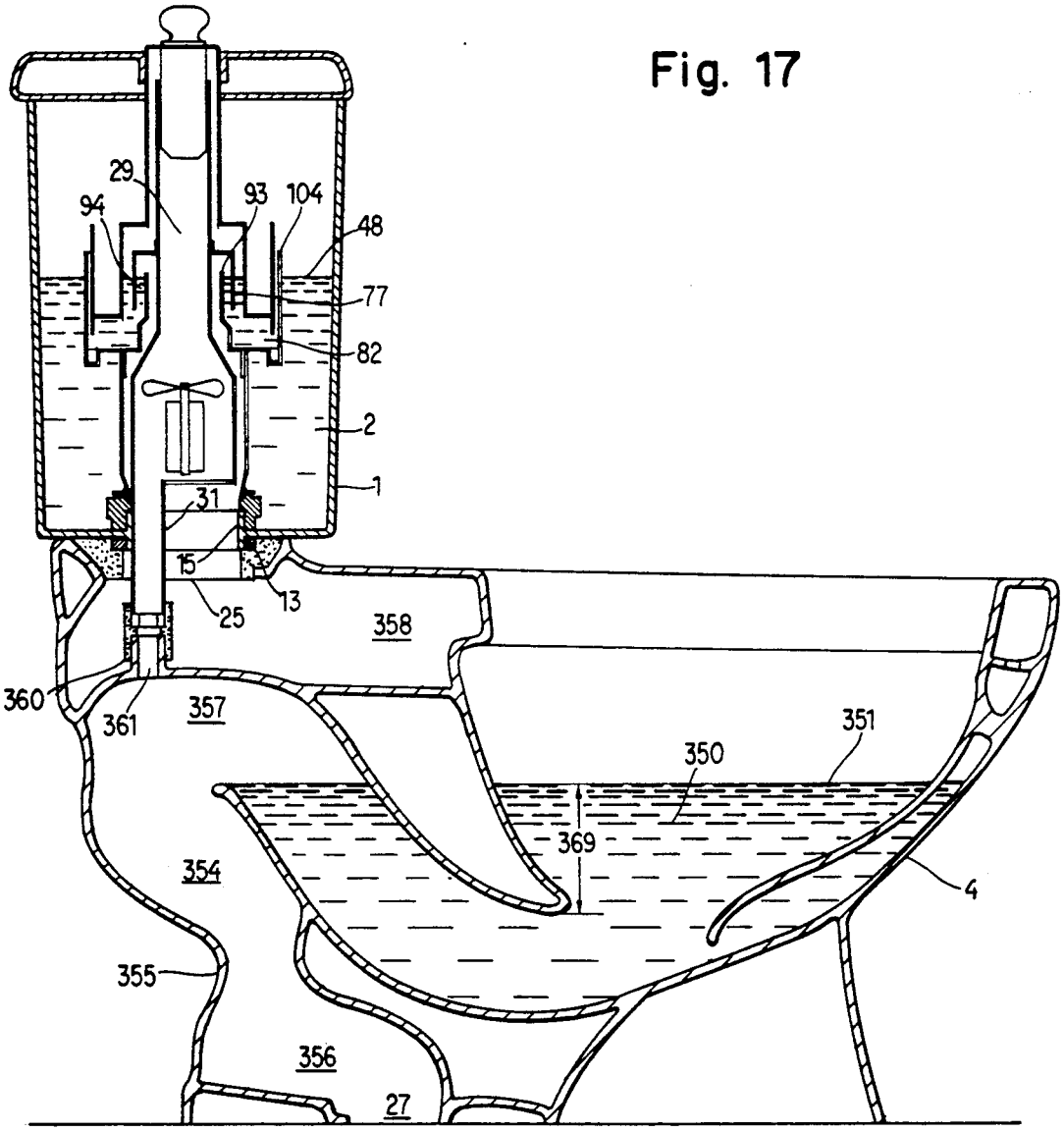
FIG. 17 shows a discharge fitting with closed flushing valve mounted on a suction toilet.
Figure 18:
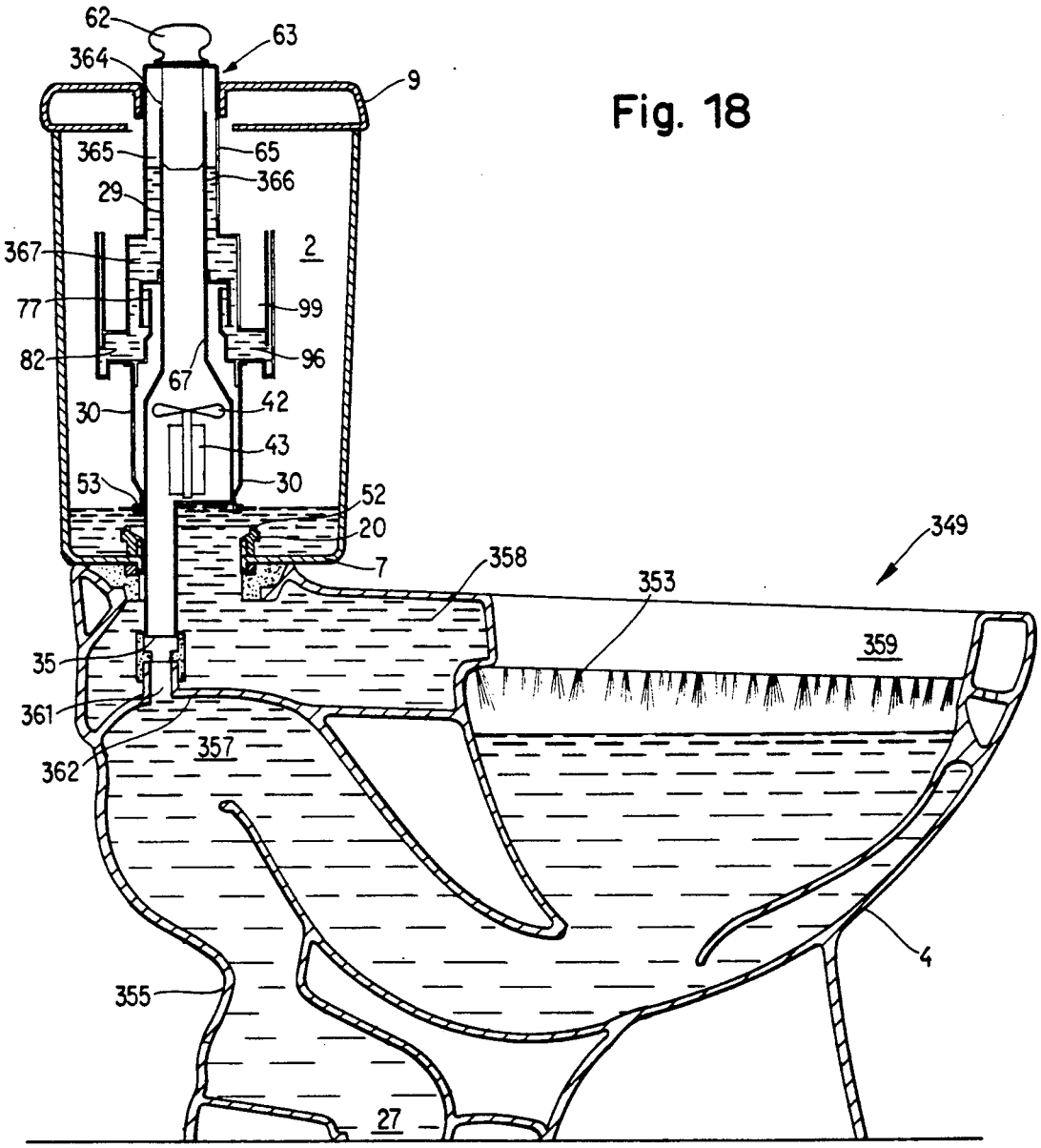
FIG. 18 shows a discharge fitting with open flushing valve mounted on a suction toilet.

The advantage of the discharge fitting 3 is that it can also be used for a suction toilet 349 (FIGS. 17 and 18) without great difficulty. In the latter, a residual body of water 350 constituting the odor trap stands in the lower portion of the toilet bowl 4. The residual body of water has an upper water level 351 whose height is determined by a deflecting edge 352. During flushing of the toilet bowl 4, a body of water 353 entering the toilet bowl 4 must rise above the deflecting edge 352 in order to arrive at a discharge feed pipe 354 which is adjacent to the deflecting edge 352. The discharge feed pipe 354 is bounded by a constriction 355 at the end thereof nearest the waste water line 27. Behind the constriction 355 is an outflow chamber 356 which increases in size towards the waste water line 27. Due to the constriction 355, the water flowing out of the toilet bowl 4 is backed up so that an upper chamber 357 is completely filled by the entering body of water 353. In the upper chamber 357, the entering body of water 353 is deflected, above the deflecting edge 352, in a direction towards the discharge feed pipe 354. The water is sucked out of the toilet bowl 4 as a result of the increase in volume behind the constriction 355.

The connecting section 31, which extends through the discharge feed pipe 13 eccentrically, opens into the upper chamber 357. The connecting section 31 is here straight and projects outwards through the lower end 25 of the discharge feed pipe 13. The connecting section 31 is essentially parallel to a center line extending through the discharge fitting 3 and passes through a distribution chamber 358. The flushing liquid enters the distribution chamber 358 through the discharge feed pipe 12 and is there uniformly distributed over the entire toilet bowl 4 along the rim of the latter.

The connecting end portion 35 of the connecting section 31 opens into a suction opening 361 which is provided in a wall 362 separating the distribution chamber 358 from the upper chamber 357. A connecting sleeve 360 concentrically surrounds the suction opening 361. The suction opening 361 lies directly below the connecting section 31.

The connecting sleeve 360 carries an elastic connecting feed pipe. The connecting feed pipe can be in the form of a double sleeve having a lower end which faces and circumferentially grips the connecting sleeve 360 and an opposed upper end which receives the connecting end portion 35 of the connecting section 31.

This arrangement of the suction opening 361 has the important advantage that the discharge fitting 3 can be very easily installed on a suction toilet 349. To this end, the connecting end portion 35 of the connecting section 31 is first pushed into the elastic sleeve 360 which is placed over the suction opening 361. Subsequently, the housing 1 is inverted with its opening 15 over the suction pipe 29 which is connected to the connecting section 31. The housing 1 is thereupon fixed on the toilet bowl 4 in a conventional manner using non-illustrated screws and nuts. The discharge feed pipe 13, together with the connecting section 31 extending through the same, can now be secured to the housing bottom 7 by means of the nut 20. The position of the valve seat 52 formed on the nut 20 is thereby fixed. The valve part 53 fastened to the extension 30 is aligned with reference to the valve seat 52 by pushing the extension 30 over the suction pipe 29.

Due to the vacuum created in the upper chamber 357, the water level in the water barrier container 82 is raised by a distance 369 which equals the height of the odor trap in the toilet bowl 4 when the water flows out of the upper chamber 357 and through the constriction 355 towards the waste water line 27. Consequently, care must be taken that the water barrier does not flow off through the suction pipe 29 towards the suction generator 42 and its drive 43. To this end, the upper edge 364 of the suction pipe 29 is extended upwards beyond the water barrier container 82 and towards the cover 9 of the housing 1 to such a degree that the upper end 366 of a water column 365 which forms as a result of the vacuum terminates below the upper edge 364. The water barrier container 82 is here disposed in a region of the housing 1 which lies at about half the height of the interior chamber 2 enclosed by the housing 1. By virtue of this arrangement of the water barrier container 82. The constriction 67 can be of very great length and extend to the cover 9 so that the upper end 366 of the water column 365 is, in any event, below the upper edge 364. Furthermore, a compensating chamber 367 capable of accommodating a substantial portion of the water barrier sucked out of the water barrier container 82 can be provided beneath the bell 63 and above the level of the water barrier 96 in the water barrier container 82. The compensating chamber 367 is located above the circumferential flange 77 as considered in a direction towards the cover 9 and between the constriction 67 and the casing part 65. In this manner, the water barrier 96 is prevented from penetrating into the suction pipe 29 upon flushing of the suction toilet 349.

Since the discharge fitting 3 is constructed as a plug, the housing 1 can be easily affixed on the toilet bowl 4 of a suction toilet 349. Both fastening of the flushing valve and placement of the extension 30 can be carried out after the housing 1 has been affixed on the toilet bowl 4.

In order to prevent uncontrolled flow of the flushing water 48 out of the interior chamber 2 of the housing, e.g., under the cover 9 of the latter, should the flushing water inlet 115 develop a leak, the flushing valve 49 is caused to open when, due to an uncontrolled inflow of the flushing water 48, the flushing water 48 in the interior chamber 2 rises above an upper level. To this end, an emergency float 368 (FIG. 6) is installed at the uppermost level of the flushing water 48 which is not to be exceeded under any circumstances. The emergency float 368 causes the flushing valve 49 to open so that flushing water 48 is conducted to the toilet bowl 4 via the flushing valve 49 if the incoming flushing water 48 cannot be adequately evacuated through the annular chamber 94 and the gap 50 between the extension 30 and the suction pipe 29. The emergency float 368 is advantageously connected to the extension 30. It has been found to be of advantage to connect the emergency float 368 to the annular outer wall 88 of the water barrier container 82. The emergency float 368 is designed to have a buoyant force so great that it is able to open the entire movable portion of the discharge fitting 3 against the closing forces acting on the flushing valve 49.

I claim:

1. A toilet flushing arrangement, for a toilet bowl comprising a housing for flushing fluid; a flushing conduit connected to said housing for establishing a connection between said housing and said toilet bowl; means for regulating the flow of flushing fluid through said flushing conduit, said regulating means including a movable tubular member in said housing and a valving element on said tubular member for sealing the interior of said flushing conduit form the interior of said housing in a predetermined position of said tubular member; a foul air conduit for conducting foul air from said flushing conduit to a foul air receiver via said tubular member, said foul air conduit extending into said housing and opening to said tubular member; and means for controlling the flow of foul air between said foul air conduit and said tubular member, said controlling means including a receptacle arranged so that a body of fluid accommodated in said receptacle seals said foul air conduit from said tubular member when the body of fluid has a predetermined volume but allows said foul air conduit to communicate with said tubular member when the body of fluid has a volume less than said predetermined volume, and said controlling means further including a shiftable expelling member for expelling fluid form said receptacle, said expelling member being shiftable through a distance sufficient to reduce the volume of fluid in said receptacle below said predetermined volume.

2. The arrangement of claim 1, wherein said housing accommodates a supply of flushing fluid, said tubular member and said foul air conduit extending through said supply.

3. The arrangement of claim 1, further comprising means for conveying foul air through said foul air conduit.

4. The arrangement of claim 3, wherein said conveying means comprises means for generating suction in said foul air conduit.

5. The arrangement of claim 1, wherein said expelling member is disposed in said receptacle.

6. The arrangement of claim 5, wherein said receptacle is arranged to accommodate a body of fluid having a second volume greater than said predetermined volume, said expelling member having a volume which approximates said second volume.

7. The arrangement of claim 1, wherein said housing has a bottom provided with an opening, said flushing conduit being disposed in said opening.

8. The arrangement of claim 7, wherein said flushing conduit is connected to said bottom.

9. The arrangement of claim 8, wherein said flushing conduit is held in said bottom by meshing threads; and further comprising means for sealing said flushing conduit in said opening.

10. The arrangement of claim 8, wherein said foul air conduit has a segment in the region of said flushing conduit and said segment is situated eccentrically with respect to said flushing conduit.

11. The arrangement of claim 1, wherein said valving element is substantially annular and said flushing conduit is provided with a substantially annular seat arranged to cooperate with said valving element.

12. The arrangement of claim 1, further comprising means for generating suction in said foul air conduit, said generating means being connected to said foul air conduit.

13. The arrangement of claim 12, further comprising driving means for said generating means, said generating means and driving means being disposed internally of said foul air conduit.

14. The arrangement of claim 12, further comprising timing means for said generating means.

15. The arrangement of claim 1, further comprising an inverted member of generally U-shaped cross section above said tubular member and said foul air conduit, said inverted member extending into said receptacle.

16. The arrangement of claim 15, wherein said receptacle accommodates a body of flushing fluid and said inverted member has a lower end portion which is immersed in said body.

17. The arrangement of claim 15, wherein said tubular member has an upper end and said receptacle is provided at said upper end.

18. The arrangement of claim 1, further comprising a source of flushing fluid for said receptacle.

19. The arrangement of claim 18, wherein said source constitutes a flushing water bypass.

20. The arrangement of claim 1, wherein said foul air conduit is connected to a foul air filter.

21. The arrangement of claim 1, wherein said foul air conduit has a lower end portion which projects form said housing and is connected to a foul air system.

22. The arrangement of claim 1, wherein said foul air conduit has a lower end portion which projects form said housing and is connected to a waste water system.

23. The arrangement of claim 1, wherein said tubular member and said foul air conduit have respective open upper ends which can communicate with said receptacle.

24. The arrangement of claim 1 wherein said foul air conduit has an upper end and said receptacle is substantially concentric with said upper end.

25. The arrangement of claim 1, wherein said foul air conduit opens into said receptacle substantially centrally.

26. The arrangement of claim 1, wherein said foul air conduit includes a peripheral wall having an upper end; and further comprising an inverted member of generally U-shaped cross section which overlies said upper end, said foul air conduit being provided with a flange which circumscribes said peripheral wall at said upper end and defines a gap with said inverted member, and said tubular member communicating with said foul air conduit by way of said gap when said receptacle contains less than said predetermined volume of fluid.

27. The arrangement of claim 26, further comprising a barrier in said gap to inhibit the rise of fluid.

28. The arrangement of claim 26, wherein said flange and said peripheral wall define a substantially annular chamber, said receptacle including a substantially annular wall which projects into said chamber, and said flange being arranged to contact a body of fluid in said receptacle when the body has said predetermined volume.

29. The arrangement of claim 28, wherein said peripheral wall and said annular wall define a compartment having an annular portion, said compartment communicating with said tubular member and with said receptacle.

30. The arrangement of claim 26, wherein said flange includes a substantially cylindrical portion which is spaced from said peripheral wall and a substantially frustoconical portion between said cylindrical portion and said peripheral wall.

31. The arrangement of claim 30, wherein said cylindrical portion and said frustoconical portion are of one piece and said frustoconical portion is fixed to said upper end.

32. The arrangement of claim 1, further comprising an inverted member of generally U-shaped cross section above said tubular member and said foul air conduit, said inverted member having a lower end portion, and said expelling member being mounted on said lower end portion and being disposed in said receptacle.

33. The arrangement of claim 32, wherein the cross section of said expelling member approximates the cross section of said receptacle.

34. The arrangement of claim 32, wherein said inverted member has a first peripheral wall, and said expelling member includes a substantially horizontal transverse wall extending outwards from said first peripheral wall and a second peripheral wall extending from said transverse wall, said receptacle including a third peripheral wall which is substantially parallel to said second peripheral wall and a bottom which is substantially parallel to said transverse wall

35. The arrangement of claim 32, wherein said expelling member is disposed in said receptacle for movement in a first direction inwards of said receptacle and a second direction outwards of said receptacle, said expelling member and said receptacle being convergent in said first direction.

36. The arrangement of claim 35, wherein said expelling member and said receptacle are substantially frustoconical.

37. The arrangement of claim 36, wherein said foul air conduit is provided with an outwardly projecting flange which includes a frustoconical portion diverging in said first direction, the slope of said receptacle being at least approximately equal to the slope of said frustoconical portion.

38. The arrangement of claim 32, wherein said expelling member is disposed in said receptacle for movement in a predetermined direction, said foul air conduit being provided with an outwardly projecting flange having a portion which is conically inclined in said predetermined direction, and said inverted member and receptacle having respective peripheral walls which are located in the region of said flange portion and are conically inclined in said predetermined direction, said receptacle having an additional, approximately cylindrical peripheral wall outwardly of the respective inclined wall, and said expelling member having an approximately cylindrical peripheral wall which is approximately parallel to, and in surface-to-surface contact with, said additional peripheral wall.

39. The arrangement of claim 32, further comprising a spring which bears against said inverted member and against said foul air conduit.

40. The arrangement of claim 1, wherein said receptacle has a bottom provided with a substantially annular recess, said expelling member being disposed in said receptacle and having a substantially annular projection receivable in said recess.

41. The arrangement of claim 1, wherein said receptacle includes an inner peripheral wall and an outer peripheral wall, at least a portion of said outer wall being lower than said inner wall to permit outflow of fluid in response to shifting of said expelling member.

42. The arrangement of claim 41, wherein said receptacle is arranged to discharge fluid into a supply of flushing fluid accommodated in said housing.

43. The arrangement of claim 1, further comprising an inverted member of generally U-shaped cross section above said tubular member and said foul air conduit, and means for coupling said inverted member to said tubular member, said expelling member being mounted on said inverted member.

44. The arrangement of claim 43, wherein said coupling means is releasable.

45. The arrangement of claim 43, wherein said receptacle is fixed to said tubular member and said coupling means is arranged to couple said inverted member to said receptacle.

46. The arrangement of claim 45, wherein said coupling means comprises at least one protuberance on said receptacle and said expelling member is engageable with said protuberance.

47. The arrangement of claim 1, further comprising an inverted member of generally U-shaped cross section above said tubular member and said foul air conduit, said inverted member being provided with a guiding element which is in engagement with said foul air conduit.

48. The arrangement of claim 47, wherein said guiding element is substantially cylindrical and is fixed to said inverted member substantially at the center of the latter, said guiding element extending into said foul air conduit.

49. The arrangement of claim 47, wherein said guiding element extends into said foul air conduit and comprises at least two radial vanes which engage said foul air conduit internally thereof.

50. The arrangement of claim 49, wherein said foul air conduit has a first segment of larger cross section and a second segment of smaller cross section, said second segment having an end which is remote from said first segment and opens into said inverted member, and said vanes being guided in said second segment.

51. The arrangement of claim 50, wherein said foul air conduit comprises a frustoconical third segment between said first and second segments, said third segment being provided with plugging means for establishing a plug connection between said first and second segments.

52. The arrangement of claim 51, wherein said plugging means is arranged to rotationally align said third segment with respect to said first and second segments.

53. The arrangement of claim 1, further comprising a float in said receptacle.

54. The arrangement of claim 53, wherein said float includes a magnet; and further comprising a switching element which is responsive to said magnet and is situated externally of said receptacle.

55. The arrangement of claim 54, further comprising means for generating suction in said foul air conduit, means for driving said generating means, and means connecting said switching element to said driving means, said switching element being disposed in said foul air conduit at a level corresponding to the level of said magnet when the volume of fluid in said receptacle is less than that required to buoy said float.

56. The arrangement of claim 54, wherein said foul air conduit has a peripheral wall and an outwardly projecting flange, said flange including a substantially cylindrical portion which circumscribes said peripheral wall and defines a compartment therewith, and said float being disposed in said compartment.

57. The arrangement of claim 54, wherein said switching element is disposed in said foul air conduit and said foul air conduit includes a plurality of segments, at least one of said segments being provided with plugging means for establishing a plug connection between said one segment and another of said segments, and said switching element being adjustable by said plugging means.

58. The arrangement of claim 1, wherein at least one of said tubular member and said receptacle is provided with plugging means for establishing a plug connection between said tubular member and said receptacle.

59. The arrangement of claim 59, wherein said receptacle has a protuberance defining a recess and said expelling member has a projection receivable in said recess, said protuberance defining said plugging means.

60. The arrangement of claim 1, further comprising a float in said receptacle, and a switching element in said foul air conduit, said float including a magnet which is in alignment with said switching element.

61. The arrangement of claim 1, wherein said said foul air conduit has at least one segment which is substantially concentric with said tubular member.

62. The arrangement of claim 61, wherein at least one of said tubular member and said foul air conduit is provided with means for fixing the relative rotational position of said tubular member and said foul air conduit.

63. The arrangement of claim 62, wherein said tubular member and said foul air conduit define a gap and said fixing means is disposed in said gap.

64. The arrangement of claim 62, wherein said fixing means includes a pair of first longitudinally extending protrusions on one of said tubular member and said foul air conduit, and a second longitudinally extending protrusion on the other of said tubular member and said foul air conduit, said first protrusions defining a space and said second protrusion being receivable in said space.

65. The arrangement of claim 1, further comprising an emergency float which is arranged to move said tubular member from said predetermined position, and thereby establish communication between said housing and said flushing conduit, when the fluid in said housing rises to a preselected level.

66. The arrangement of claim 65, wherein said receptacle is connected to said tubular member and said emergency float is mounted on the exterior of said receptacle.

67. The arrangement of claim 66, wherein said emergency float is adhesively secured to said receptacle.

68. The arrangement of claim 1, wherein said tubular member and said foul air conduit constitute part of an evacuating unit, said housing having an opening, and said unit being mounted in said opening.

69. The arrangement of claim 68, further comprising a nut-like member for fixing said unit in said opening, said nut-like member being provided with a valve seat which is arranged to cooperate with said valving element.

70. The arrangement of claim 69, wherein said flushing conduit constitutes part of said unit and extends through said opening, said flushing conduit having an external thread and a collar which is disposed adjacent to said housing on the exterior thereof, said collar defining a recess which faces said housing; and further comprising a sealing element in said recess, said nut-like member having an internal thread which meshes with said external thread to urge said sealing element against said housing.

71. The arrangement of claim 68, wherein said flushing conduit constitutes part of said unit and extends through said opening, said flushing conduit including a peripheral wall, and a portion of said peripheral wall being located externally of said housing, said foul air conduit having a segment which is disposed internally of, and is eccentric in relation to, said flushing conduit, and said segment of said foul air conduit passing through said portion of said peripheral wall and being fast with said flushing conduit.

72. The arrangement of claim 68, wherein said housing has a bottom and said opening is provided in said bottom; and further comprising a nut-like member for fixing said unit in said opening, said tubular member having a lower end, and said valving element being disposed at said lower end, said nut-like member being provided with a valve seat which is arranged to cooperate with said valving element.

73. The arrangement of claim 1, wherein at least one of said tubular member and said valving element is provided with plugging means for establishing a plug connection between said tubular member and said valving element.

74. The arrangement of claim 1, wherein said valving element comprises a seal, and means for holding said seal, said holding means including a rim which extends circumferentially of said valving element, and said seal resting on said rim.

75. The arrangement of claim 24, wherein said tubular member and said foul air conduit constitute part of an evacuating unit, said housing having an opening, and said unit being mounted in said opening; and further comprising a nut-like member for fixing said unit in said opening, said nut-like member being provided with a substantially annular protuberance having a valve seat which is arranged to cooperate with said seal, and said nut-like member and said valving element having complementary conical surfaces which are arranged to bear against one another when said seal contacts said valve seat.

76. The arrangement of claim 1, wherein said foul air conduit has a segment which is eccentric in relation to said flushing conduit, said flushing conduit and said segment of said foul air conduit having a common wall.

77. The arrangement of claim 1, wherein said foul air conduit comprises a first segment of larger cross section in said tubular member and a second segment of smaller cross section which extends through said flushing conduit, at lest one of said segments being provided with plugging means for establishing a plug connection between said first and second segments.

78. The arrangement of claim 77, wherein said first segment has an end portion in the region of said second segment, said end portion including a wall which is downwardly inclined in a direction from said first segment towards said second segment.

79. The arrangement of claim 78, wherein said foul air conduit has a skirt which cooperates with said inclined wall to define a pocket for the interception of flushing fluid.

80. The arrangement of claim 1, wherein said foul air conduit has a segment which si disposed in said tubular member and cooperates therewith to define a gap; and further comprising means in said gap for inhibiting travel of flushing fluid along said gap.

81. The arrangement of claim 80, wherein said inhibiting means comprises at least two ring segments which are spaced from one another.

82. The arrangement of claim 1, further comprising a solenoid valve for inhibiting backflow of foul odors through said foul air conduit.

83. The arrangement of claim 82, wherein said solenoid valve is disposed in said foul air conduit.

84. The arrangement of claim 82, wherein said valving element constitutes part of a flushing valve and said solenoid valve is disposed externally of said flushing valve.

85. The arrangement of claim 82, further comprising a stop below said housing; and wherein said solenoid valve is disposed beneath said stop.

86. The arrangement of claim 1, further comprising means for generating suction in said foul air conduit, and an electrical line for supplying power to said generating means, said electrical line extending through said foul air conduit.

87. The arrangement of claim 86, wherein said housing has a bottom portion and said valving element constitutes part of a flushing valve located in said bottom portion; and further comprising an electrical box which is mounted on said bottom portion, said electrical line being connected to said electrical box.

88. The arrangement of claim 86, wherein said valving element constitutes part of a flushing valve situated at a first level; and further comprising an electrical box which is disposed at a second level higher than said first level, said electrical line being connected to said electrical box.

89. The arrangement of claim 86, further comprising relay means in said foul air conduit for controlling said generating means.

90. The arrangement of claim 1, wherein said receptacle is provided with an overflow which opens into said tubular member.

91. The arrangement of claim 1, further comprising a float in said receptacle, and a switching element eternally of said receptacle, said float including an eccentrically arranged magnet, and said switching element being responsive to said magnet.

92. The arrangement of claim 1, further comprising an inverted member of generally U-shaped cross section above said tubular member and said foul air conduit, said inverted member being mounted on said handle.

93. The arrangement of claim 92, further comprising an inverted member of generally U-shaped cross section above said tubular member and said foul air conduit, said inverted member being mounted on said handle.

94. The arrangement of claim 93, wherein said inverted member is provided with a guiding element which is in engagement with said foul air conduit, said inverted member being connected to said handle in the region of said guiding element.

95. The arrangement of claim 1, further comprising an electromagnet for shifting said expelling member.

96. The arrangement of claim 1, further comprising a float for controlling movement of said tubular member.

97. The arrangement of claim 96, wherein said float is slidably mounted on said tubular member; and further comprising a coupling element for coupling said float to said tubular member.

98. The arrangement of claim 97, wherein said coupling element comprises a clamping ring on said tubular member, said clamping ring being disposed above said float.

99. The arrangement of claim 97, wherein said coupling element is mounted on said tubular member, said coupling element being movable between a first position nearer said valving element in which the flushing period is short and a second position remote from said valving element in which the flushing period is long.

100. The arrangement of claim 96, wherein said tabular member and said foul air conduit constitute part of an evacuating unit having a movable portion which includes said tubular member, said float having a buoyant force smaller than the weight of said movable portion.

101. The arrangement of claim 100, wherein the flushing period is a function of said buoyant force.

102. The arrangement of claim 100, wherein the volume of flushing fluid per flush is a function of said buoyant force and said buoyant force is selected so that said volume equals or approximates 9 liters.

103. The arrangement of claim 100, wherein the volume of flushing fluid per flush is a function of said buoyant force and said buoyant force is selected so that said volume equals or approximates 6 liters.

104. The arrangement of claim 96, further comprising a container for said float.

105. The arrangement of claim 105, wherein said tubular member and said foul air conduit constitute part of an evacuating unit, said container surrounding said unit and being spaced therefrom.

106. The arrangement of claim 104, wherein said tubular member and said valving element are shiftable vertically and said container is disposed above the uppermost position of said valving element.

107. The arrangement of claim 104, wherein said valving element constitutes part of a flushing valve, said container having a bottom disposed at a level such that said flushing valve is closed when said float rests on said bottom.

108. The arrangement of claim 107, wherein said bottom is provided with openings for the discharge of fluid from said container.

109. The arrangement of claim 104, wherein said housing has a bottom; and further comprising means for supporting said container on said bottom.

110. The arrangement of claim 109, wherein said supporting means comprises a plurality of legs which are distributed substantially uniformly circumferentially of said container.

111. The arrangement of claim 110, wherein said legs are elastic and are releasably connected with said bottom.

112. The arrangement of claim 111, further comprising means for holding said legs on said bottom, said holding means including pockets which open towards said flushing conduit, and said legs having end portions which are directed away from said flushing conduit and are receivable in said pockets.

113. The arrangement of claim 111, further comprising means for holding said legs on said bottom, said holding means including a collar which surrounds said flushing conduit and defines a pocket opening towards said flushing conduit, and said legs having end portions which are directed away form said flushing conduit and are receivable in said pocket.

114. The arrangement of claim 104, further comprising a nut-like member for fixing said flushing conduit to said housing, said container being supported on said nut-like member.

115. The arrangement of claim 114, further comprising a plurality of legs for supporting said container on said nut-like member, said legs being substantially uniformly distributed circumferentially of said container, and said nut-like member being provided with a plurality of substantially uniformly distributed peripheral slots, said legs being receivable in said slots.

116. The arrangement of claim 115, wherein said nut-like member has a collar and said slots are provided in said collar, said legs having end portions which are directed towards said flushing conduit and engage said collar from below when said legs are received in said slots.

117. The arrangement of claim 116, further comprising a releasing member which is rotatably mounted on said nut-like member below said collar, said releasing member having an asymmetrical periphery such that selected locations of said releasing member can contact said end portions upon rotation of said releasing member to thereby disengage said legs from said collar.

118. The arrangement of claim 1, wherein said valving element constitutes part of a flushing valve; and further comprising means for resiliently biasing said tubular member in a sense to open said valve.

119. The arrangement of claim 118, wherein said housing has a bottom and said biasing means includes a prestressed coil spring which bears against said bottom.

120. The arrangement of claim 118, further comprising a float for controlling movement of said tubular member, and a container for said float, said container having a bottom, and said float surrounding said tubular member, said biasing means including a prestressed coil spring which surrounds said tubular member and bears against said bottom, and said coil spring being disposed between said tubular member and said float.

121. The arrangement of claim 120, further comprising a coupling element for coupling said float to said tubular member, said coupling element including a clamping ring on said tubular member, and said coil spring bearing against said clamping ring.

122. The arrangement of claim 1, further comprising means for adjusting the relative position of said receptacle and said expelling member, said adjusting means including at least one spacer between said flushing conduit and said housing.

123. The arrangement of claim 1, further comprising means for generating suction in said foul air conduit, means for driving said generating means, and means for shielding said driving means from explosive gases, said shielding means including a grid.

124. The arrangement of claim 123, wherein said driving means is located in said foul air conduit and said grid is disposed between said driving means and the foul air receiver.

125. The arrangement of claim 124, wherein said generating means is located in said foul air conduit and forms a suction unit with said driving means, said shielding means further comprising an additional grid which is arranged so that said unit is sandwiched between said grids.

126. The arrangement of claim 1, further comprising a toilet bowl having a withdrawal opening for waste, a withdrawal conduit upstream of said withdrawal opening and having a constriction, an elevated chamber upstream of and above said withdrawal conduit, and an odor trap upstream of said elevated chamber, said foul air conduit opening into said elevated chamber.

127. The arrangement of claim 126, wherein said valving element constitutes part of a flushing valve and said bowl further comprises a distribution chamber for flushing fluid downstream of and adjacent to said flushing valve, said tubular member and said foul air conduit constituting part of an evacuating unit, and said foul air conduit including a substantially straight segment which is essentially parallel to, and is eccentrically disposed in relation to, the remainder of said unit, said straight segment extending through said distribution chamber.

128. The arrangement of claim 127, wherein said bowl includes a dividing wall between said elevated chamber and said distribution chamber, said dividing wall being provided with an outlet opening, and said bowl further including a tubular stub which communicates with said outlet opening and is connected to said straight segment.

129. The arrangement of claim 128, wherein said outlet opening and said straight segment lie on a substantially straight line.

130. The arrangement of claim 128, wherein said tubular stub projects into said distribution chamber; and further comprising an elastic, sleeve-like member which receives said tubular stub and said straight segment.

131. The arrangement of claim 126, wherein a vacuum is created in said bowl during flushing and produces a fluid column at said receptacle which rises to a predetermined level, said foul air conduit having an upper end above said predetermined level.

132. The arrangement of claim 126, wherein a vacuum is created in said bowl during flushing and causes fluid to rise at said receptacle; and further comprising an inverted member of generally U-shaped cross section above said tubular member and said foul air conduit, and a reservoir between said receptacle and said inverted member to prevent excessive rise of fluid.

133. The arrangement of claim 132, wherein said foul air conduit has a peripheral wall and an outwardly projecting flange having a portion which extends circumferentially of said peripheral wall, said foul air conduit including a first segment of smaller cross section having a lower end and a second segment of larger cross section below said first segment; and wherein said reservoir is located between said lower end and said inverted member and above said flange portion.

134. The arrangement of claim 132, wherein said housing has a bottom and a top and said receptacle is disposed at least approximately midway between said bottom and said top, said foul air conduit including a first segment of smaller cross section and a second segment of larger cross section below said first segment, and said first segment extending to the vicinity of said top.

135. The arrangement of claim 1, wherein said tubular member and said foul air conduit are arranged side-by-side and are substantially parallel to one another; and further comprising an inverted member of generally U-shaped cross section above said tubular member and said foul air conduit.

136. The arrangement of claim 135, wherein said inverted member defines an annular chamber having first and second openings, said tubular member extending through one of said openings and said foul air conduit extending through the other of said openings.

137. The arrangement of claim 135, wherein said foul air conduit has an end portion which is received in said inverted member and said receptacle is secured to said end portion.

138. The arrangement of claim 137, wherein said inverted member has an opening for said end portion and said expelling member is secured to said inverted member in the region of said opening.

139. The arrangement of claim 135, wherein said inverted member has a transverse wall which extends over both said tubular member and said foul air conduit; and further comprising a flushing handle which is mounted on said transverse wall.

140. The arrangement of claim 139, wherein said expelling member is secured to said inverted member and said handle is disposed directly above said expelling member.

141. The arrangement of claim 139, wherein said foul air conduit has a peripheral wall and an outwardly projecting flange having a portion which extends circumferentially of said peripheral wall; and further comprising a resilient biasing element below said flushing handle and between said transverse wall and said flange portion.

142. The arrangement of claim 135, wherein said inverted member has an opening for said tubular member; and further comprising means in the region of said opening for coupling said tubular member and said inverted member to one another.

143. The arrangement of claim 135, wherein said valving element constitutes part of a flushing valve and said flushing valve is disposed directly below said tubular member.

144. The arrangement of claim 143, wherein said flushing conduit engages said flushing valve and said flushing valve opens into said flushing conduit.

145. The arrangement of claim 135, wherein said foul air conduit includes a substantially annular chamber which surrounds said flushing conduit, said foul air conduit having first and second segments which communicate with said annular chamber at spaced locations of the latter.

146. The arrangement of claim 145, wherein said housing has a bottom, said foul air conduit further comprising first and second distribution chambers which surround said annular chamber, each of said distribution chambers communicating with said annular chamber via plurality of openings, and said first distribution chamber being located internally of said housing in the region of said bottom, said second distribution chamber being located externally of said housing in the region of said bottom, and said first segment being disposed above said bottom and being connected to said first distribution chamber, said second segment being disposed below said bottom and being connected to said second distribution chamber, and said segments being disposed adjacent to, and extending in approximate parallelism with, said bottom.

147. The arrangement of claim 145, wherein said housing has a bottom and said flushing conduit and said annular chamber pass through said bottom.

* * * * *

UNITED STATES PATENT AND TRADEMARK OFFICE

CERTIFICATE OF CORRECTION

PATENT NO. : 5,123,125

DATED : June 23, 1992

INVENTOR(S) : Heinrich MENGE

Figure 5:
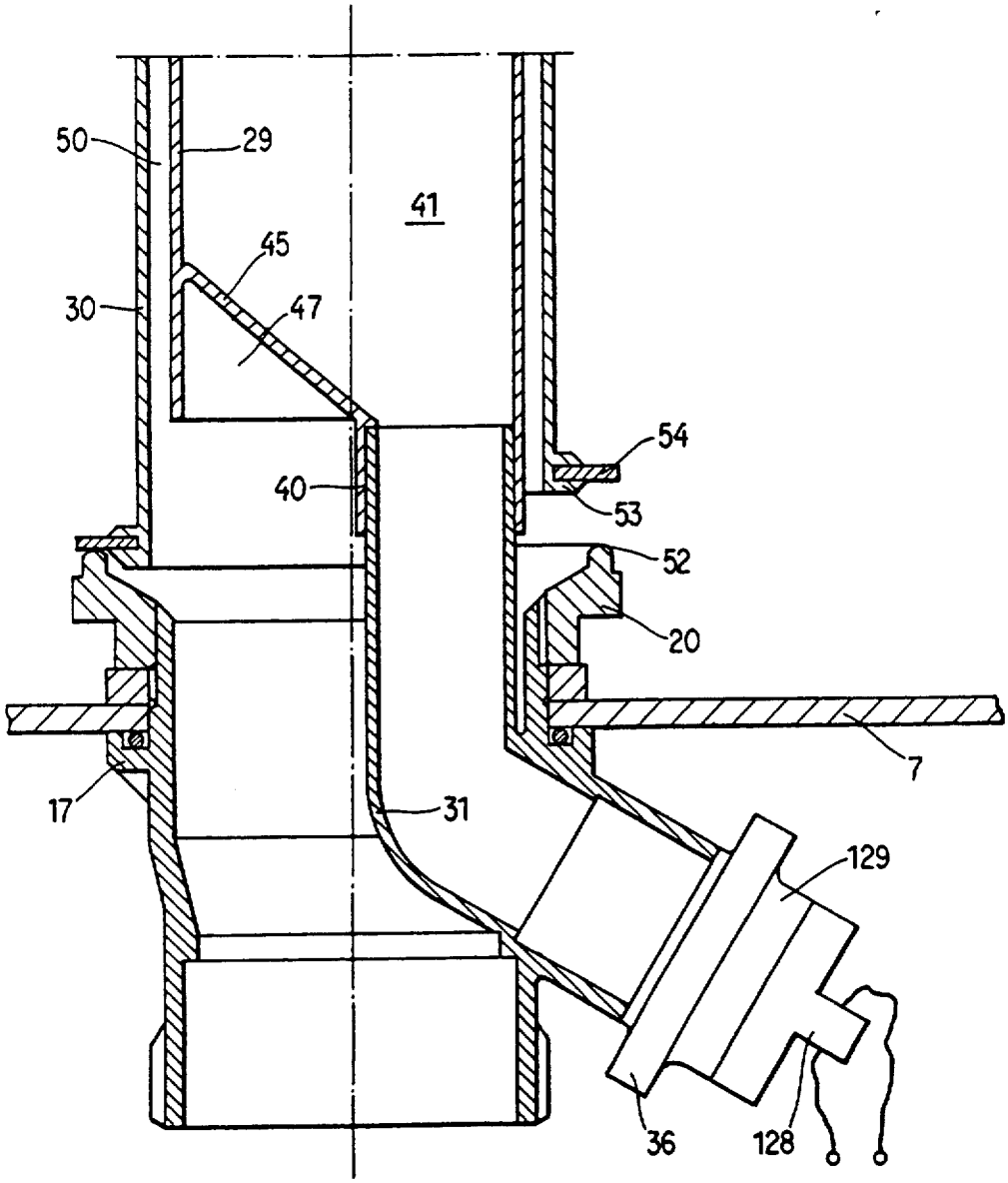
FIG. 5 is a longitudinal section through a lower portion of a discharge fitting with another solenoid valve.

It is certified that error appears in the above-identified patent and that said Letters Patent is hereby corrected as shown below:

In the Drawings:

Add the drawing sheet, consisting of Fig 5, as shown on the attached page.

Col. 3, line 60, "condition" should read --conditions--.
Col. 8, line 47, "B2" should read --82--.
Col. 12, line 30, delete the "," after "ring" (second occurrence).
Col. 12, line 47, ")" (first occurrence) should read -- ( --;
line 48, "33" should read --313--;
Col. 12, line 49, after "314" insert --(FIG. 8)--.
Col. 14, line 33, "334" should be deleted.
Col. 18, line 27, "form" should read --from--.
Col. 22, line 65, "si" should read --is--.
Col. 23, line 40, "eter-" should read --exter- --.
line 44, Claim 92 should read --The arrangement of claim 1, further comprising a depressible flushing handle, said expelling member being mounted on said handle.--.

Signed and Sealed this

Twelfth Day of October, 1993

*Attest:*

*Attesting Officer*

Bruce Lehman

BRUCE LEHMAN

*Commissioner of Patents and Trademarks*